US008052064B2

(12) United States Patent
Yukimoto

(10) Patent No.: US 8,052,064 B2
(45) Date of Patent: Nov. 8, 2011

(54) EXPANSION VALVE WITH REFRIGERANT FLOW DIVIDING STRUCTURE AND REFRIGERATION UNIT UTILIZING THE SAME

(75) Inventor: Tooru Yukimoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 366 days.

(21) Appl. No.: 12/301,216

(22) PCT Filed: Jun. 27, 2007

(86) PCT No.: PCT/JP2007/062879

§ 371 (c)(1),
(2), (4) Date: Nov. 17, 2008

(87) PCT Pub. No.: WO2008/001803

PCT Pub. Date: Jan. 3, 2008

(65) Prior Publication Data

US 2009/0183520 A1 Jul. 23, 2009

(30) Foreign Application Priority Data

Jun. 29, 2006 (JP) ..... 2006-180317
May 30, 2007 (JP) ..... 2007-143947

(51) Int. Cl.
*F25B 41/04* (2006.01)
*F16K 47/00* (2006.01)

(52) U.S. Cl. ..... 236/92 B; 62/222; 251/121; 251/126

(58) Field of Classification Search ..... 236/92 B, 236/92 R, 93 B, 93 R; 62/222; 251/121, 251/122, 126

See application file for complete search history.

(56) References Cited

U.S. PATENT DOCUMENTS 7,832,653 B2 * 11/2010 Yukimoto ..... 236/92 B

FOREIGN PATENT DOCUMENTS

| | | | | |
|---|---|---|---|---|
| JP | 49-122453 | U | | 10/1974 |
| JP | 52-89851 | A | | 7/1977 |
| JP | 2-71064 | A | | 3/1990 |
| JP | 6-2990 | A | | 1/1994 |
| JP | 6-201225 | A | | 7/1994 |
| JP | 6-337183 | A | | 12/1994 |
| JP | 8-61809 | A | | 3/1996 |
| JP | 2000-111205 | A | | 4/2000 |
| JP | 2001-66019 | A | | 3/2001 |
| JP | 2002-188869 | A | | 7/2002 |
| JP | 2002-350003 | A | | 12/2002 |
| JP | 2003-97754 | A | | 4/2003 |
| JP | 2004108763 | A | * | 4/2004 |
| JP | 2005-69644 | A | | 3/2005 |
| JP | 2005-226846 | A | | 8/2005 |
| JP | 2005-351605 | A | | 12/2005 |
| WO | WO-2005/075903 | A1 | | 8/2005 |

* cited by examiner

*Primary Examiner* — Chen Wen Jiang
(74) *Attorney, Agent, or Firm* — Birch, Stewart, Kolasch & Birch, LLP.

(57) ABSTRACT

An expansion valve of the present invention has a structure which integrates a refrigerant flow divider. The expansion valve includes a refrigerant flow dividing chamber 6 on the downstream side of a first throttle 10. Flow dividing tubes 12 are connected to the refrigerant flow dividing chamber 6. In the expansion valve, refrigerant which has passed through the first throttle 10 is sprayed into the refrigerant flow dividing chamber 6, so that the flow dividing characteristic of the refrigerant is improved. Also, due to an enlargement of the passage in the refrigerant flow dividing chamber 6, the ejection energy of a flow of the refrigerant ejected from the first throttle 10 is dispersed, whereby a discontinuous refrigerant flow noise is reduced.

4 Claims, 25 Drawing Sheets

EXPANSION VALVE WITH REFRIGERANT FLOW DIVIDING STRUCTURE AND REFRIGERATION UNIT UTILIZING THE SAME

TECHNICAL FIELD

The present invention relates to an expansion valve with a refrigerant flow dividing structure and a refrigeration unit using the same.

BACKGROUND ART

In a refrigeration unit such as an air conditioner, a refrigerator, and a cooling device for manufacturing, in some cases, an evaporator includes a plurality of paths (refrigerant flow passages in a heat exchanger). For example, in a refrigerant circuit shown in FIG. 43, a refrigerant compressed by a compressor 201 is condensed in a condenser 202, and passes through a receiver 203 to be sent to an expansion valve 204. A refrigerant decompressed by the expansion valve 204 is sent to a refrigerant flow divider 206 through a refrigerant conduit 205 and is divided by the refrigerant flow divider 206 to be sent to a plurality of paths of an evaporator 207. A low-pressure refrigerant is evaporated in the evaporator 207 and then returns to the compressor 201 through an accumulator 208. In a case where the evaporator 207 includes a plurality of paths as described above, the refrigerant flow divider 206 is connected to the expansion valve 204 through the refrigerant conduit 205. The refrigerant flow divider 206 uniformly divides the refrigerant decompressed by the expansion valve 204 into a plurality of paths of the evaporator 207. The refrigerant flow divider 206, as disclosed in Patent Document 1, has a predetermined volume and includes a space (refrigerant flow dividing chamber) for distributing a refrigerant. A flow dividing tube attachment hole used to connect the refrigerant flow dividing chamber and each path of the evaporator 207 is formed in the refrigerant flow divider 206. When decompressed in the expansion valve 204, refrigerant is converted to a low-pressure gas-liquid two-phase flow refrigerant before flowing into the refrigerant flow divider 206. Such a gas-liquid two-phase flow refrigerant is apt to create a plug flow or a slug flow containing big bubbles when it flows in the refrigerant conduit 205 which connects the expansion valve 204 and the refrigerant flow divider 206. When such a plug flow or a slug flow occurs, due to influence of gravity or the like, bubbles do not uniformly flow into each flow dividing tube attached to each flow dividing tube attachment tube, whereby the refrigerant becomes hard to be uniformly divided.

In order to realize the uniform division, in Patent Document 1, a throttle (path narrowing member) having a constant opening degree is disposed on the upstream side of the flow dividing tube attachment hole, so that a refrigerant becomes a spray state at a further downstream side than the throttle.

Meanwhile, refrigerant flowing into an expansion valve is a high-pressure liquid refrigerant, but due to a change in an operating condition of a refrigeration unit, bubbles may be contained in a refrigerant near an upstream side of an expansion valve, i.e., an outlet of a receiver or an outlet of a condenser. In this case, bubbles in the high-pressure liquid refrigerant are heated from the outside of a refrigerant conduit and so is expanded or united with each other while circulating in the refrigerant conduit. As a result, a plug flow or a slug flow occurs, so that liquid refrigerant and gaseous refrigerant alternately flow through the throttle. For this reason, the velocity and pressure of a refrigerant flow fluctuate, or the ejection velocity and ejection pressure of refrigerant ejected from the throttle to the refrigerant conduit fluctuate, so that a refrigerant flow noise is generated. Also, an expansion valve or equipment near the expansion valve such as a connecting conduit vibrates, causing a vibration noise. In order to reduce such a discontinuous refrigerant flow noise, in Patent Document 2, as a means for mitigating fluctuation in the velocity and pressure of a refrigerant flow, a throttle for decompressing a refrigerant flow is installed on the upstream side of a throttle. Also, in Patent Document 3, a turbulence generating portion for generating turbulence in a refrigerant flow is installed on the upstream side of a throttle. Also, in Patent Document 4, a throttle for decompressing a refrigerant flow is installed on the downstream side of a throttle.

Patent Document 1: Japanese Laid-Open Patent Publication No. 2002-188869

Patent Document 2: Japanese Unexamined Patent Publication No. 2005-69644

Patent Document 3: Japanese Unexamined Patent Publication No. 2005-351605

Patent Document 4: Japanese Unexamined Patent Publication No. 2005-226846

DISCLOSURE OF THE INVENTION

In a conventional refrigerant flow divider, in order to perform the uniform division, a throttle is installed on the upstream side of a flow dividing tube attachment hole. However, since a throttle is also installed in an expansion valve disposed on an upstream side of a refrigerant flow divider, the same elements are installed in different parts, respectively. Meanwhile, in a conventional expansion valve, in order to reduce a refrigerant flow noise in an expansion valve, means for mitigating fluctuation in the velocity and pressure of a refrigerant flow is installed. However, due to the mitigating means, the size of the expansion valve increases, thereby increasing the cost.

It is an objective of the present invention to provide an expansion valve in which the structure of a refrigerant circuit which extends from an expansion valve to a refrigerant flow divider is simplified, and a discontinuous refrigerant flow noise is reduced in an expansion valve, thereby achieving a refrigerant flow dividing structure in which the flow dividing characteristic of the refrigerant of a refrigerant flow divider is improved. Another objective is to provide a refrigeration unit using the expansion valve.

In order to achieve the objective, according to a first aspect of the present invention, there is provided an expansion valve with a refrigerant flow divider structure comprising: a first throttle formed by a first valve body and a first valve hole, wherein the opening degree of the first valve hole is adjusted by the first valve body, a refrigerant flow dividing chamber for dividing a refrigerant which has passed through the first throttle into a plurality of flow dividing tubes, and flow dividing tube attachment holes which are provided in the refrigerant flow dividing chamber and to which each of the flow dividing tubes is attached. According to the expansion valve, the first throttle is formed integrally with the refrigerant flow dividing chamber.

Due to the above-described configuration, bubbles in a refrigerant which has passed through the first throttle are subdivided, and the refrigerant is sprayed directly to the refrigerant flow dividing chamber, whereby the flow dividing characteristic of the refrigerant is improved. Also, since the refrigerant flow dividing chamber functions as an enlarged space portion, the ejection energy of a flow of the refrigerant flowing out of the first throttle can be dispersed. Therefore, when a refrigerant becomes a plug flow or a slug flow on the upstream side of the first throttle, the pressure fluctuation of a refrigerant flow is mitigated, whereby a discontinuous refrigerant flow noise is reduced. Also, since the expansion valve and the refrigerant flow divider are integrally formed, a configuration which extends from the expansion valve to the refrigerant flow divider is simplified, and the installation space is smaller, leading to reduced cost.

In the expansion valve, preferably, the opening degree of the first valve hole can be varied according to a refrigeration load. In this case, unlike the conventional refrigerant flow divider having a throttle with a constant opening degree, a throttling degree can be appropriately adjusted according to an operating condition such as a flow rate and a drying degree, thereby further improving the flow dividing characteristic of the refrigerant.

Preferably, the expansion valve includes a valve chamber which accommodates the first valve body, and the valve chamber is formed on the upstream side of the first throttle. In this case, the refrigerant flow dividing chamber and the like can be designed while maintaining the configuration of the conventional valve chamber, whereby the design of the refrigerant flow dividing chamber is less restricted.

In the expansion valve, preferably, the refrigerant flow dividing chamber is formed on the downstream side of the first throttle. The refrigerant flow dividing chamber can be designed while maintaining the configuration of the conventional valve chamber, whereby design of the refrigerant flow dividing chamber is less restricted.

Preferably, the expansion valve includes a valve chamber which accommodates the first valve body, and the valve chamber includes the refrigerant flow dividing chamber. In this case, a configuration which extends from the expansion valve to the refrigerant flow diver is further simplified.

Preferably, the expansion valve includes bubble subdividing means for subdividing bubbles in a refrigerant on the upstream side of the first throttle. In this case, when a slug flow or a plug flow occurs on the upstream side of the expansion valve, bubbles in a refrigerant flowing on the upstream side of the first throttle are subdivided by the bubble subdividing means. As a result, a refrigerant flow toward the first throttle becomes continuous, and so the velocity fluctuation and the pressure fluctuation of the refrigerant flow are mitigated. Accordingly, a discontinuous refrigerant flow noise is reduced. Also, since a spraying state of a refrigerant on the downstream side of the first throttle is stabilized, a refrigerant flow division in the refrigerant flow dividing chamber is stabilized.

In the expansion valve, preferably, the bubble subdividing means includes a second throttle for decompressing a refrigerant of an upstream side of the first throttle. In this case, when a refrigerant becomes a plug flow or a slug flow on the upstream side of the expansion valve, bubbles in a refrigerant are subdivided by the second throttle. As a result, a refrigerant flow toward the first throttle becomes continuous, and so the velocity fluctuation and the pressure fluctuation of the refrigerant flow are mitigated. Also, due to the multi-step throttling structure including the second throttle and the first throttle, the ejection energy of the refrigerant flow is effectively dispersed. As a result, the velocity fluctuation and the pressure fluctuation of a refrigerant flow are further mitigated, a spraying state of a refrigerant on the downstream side of the first throttle is further stabilized, whereby a refrigerant flow division in the refrigerant flow dividing chamber is further stabilized.

In the expansion valve, preferably, the bubble subdividing means includes a second throttle for decompressing a refrigerant of an upstream side of the first throttle and an enlarged space portion formed between the first throttle and the second throttle. In this case, after bubbles in a refrigerant are subdivided by the second throttle, the ejection energy of a refrigerant flow is dispersed in the enlarged spaced portion, whereby bubbles in refrigerant flowing into the first throttle are further subdivided.

In the expansion valve, preferably, the second throttle includes a plurality of throttling passages. If the throttle includes a single passage, the velocity and pressure of a refrigerant flow easily fluctuate on the downstream side of the throttle according to a change of a refrigerant flow in the throttle. However, if the throttle includes a plurality of passages, a different gas-liquid flow state is formed in each passage. As a result, on the downstream side of the throttle in which refrigerants flowing through the respective passages gather, the velocity fluctuation and the pressure fluctuation of a refrigerant flow can be prevented as much as possible. Also, since refrigerant is ejected from a plurality of passages which constitute the throttle, a flow of the refrigerant ejected from the second throttle is shaken up, whereby bubbles in a refrigerant flowing on the downstream side of the second throttle are further subdivided.

In the expansion valve, preferably, the bubble subdividing means includes a turbulence generating portion for generating a turbulent flow in a refrigerant flow in an upstream side of the first throttle. In this case, as the turbulence generating portion, for example, one which has a helical groove for bringing a swirling flow to a refrigerant flow in a refrigerant passage, one which has only the enlarged space portion, and one which has a turning-around portion in a refrigerant passage may be considered. A turbulent flow can be generated in a refrigerant flowing on the upstream side of the first throttle by such a turbulence generating portion, whereby bubbles in a refrigerant are subdivided.

In the expansion valve, preferably, the turbulence generating portion has a helical groove for swirling a refrigerant flow in an upstream side of the first throttle. In this case, since a refrigerant flow toward the first throttle is swirled, bubbles in a refrigerant are subdivided.

In the expansion valve, preferably, the bubble subdividing means includes a porous permeable layer installed on the upstream side of the first throttle. In this case, bubbles in a refrigerant flow toward the first throttle are subdivided by the porous permeable layer. Also, clogging of the first throttle by foreign substances is prevented by the porous permeable layer.

Preferably, the expansion valve includes a third throttle for decompressing a refrigerant which has passed through the first throttle formed on the downstream side of the first throttle, wherein the refrigerant flow dividing chamber is formed on the downstream side of the third throttle. In this case, the ejection energy of a refrigerant flow which has passed through the first throttle is consumed by a decompression operation of the third throttle. Also, since the two-step throttle in which the first throttle and the third throttle are serially disposed is provided, the ejection energy of refrigerant is reduced when passing through each throttle. As a result, the velocity fluctuation and the pressure fluctuation of a refrigerant flow are mitigated, whereby a discontinuous refrigerant flow noise is reduced. Also, since bubbles in refrigerant flowing into the refrigerant flow dividing chamber are further subdivided by the third throttle, a refrigerant can be more uniformly divided.

Preferably, the expansion valve includes an enlarged space portion between the first throttle and the third throttle. In this case, the ejection energy of a refrigerant flow which has passed through the first throttle is dispersed in the enlarged spaced portion. As a result, the ejection energy of a flow of the refrigerant ejected to the refrigerant flow dividing chamber through the third throttle is reduced, whereby the velocity fluctuation and the pressure fluctuation of a refrigerant flow are further mitigated.

In the expansion valve, the third throttle preferably includes a plurality of throttling passages. In this case, since a different gas-liquid flow state is formed in each passage, on the downstream side of the third throttle in which refrigerants flowing through the respective passages are gathered, the velocity fluctuation and the pressure fluctuation of a refrigerant flow are further mitigated.

In the expansion valve, the third throttle preferably includes a helical passage. In this case, since a throttling passage becomes longer, the direction of a flow of the refrigerant ejected from the third throttle becomes uniform, whereby the velocity fluctuation and the pressure fluctuation of refrigerant flowing into the refrigerant flow dividing chamber are further mitigated. Also, bubbles in refrigerant flowing into the refrigerant flow dividing chamber are further subdivided.

In the expansion valve, preferably, a turbulent flow generating member having a helical groove on an outer surface is installed in the refrigerant flow dividing chamber, and the turbulent flow generating member is installed coaxially with the first valve hole. In this case, a refrigerant flow which has passed through the first throttle is shaken up by the turbulent flow generating member having a helical groove on an outer surface. As a result, the flow state of refrigerant flowing into each of the flow dividing tube attachment holes becomes uniform, thereby improving the flow dividing characteristic of the refrigerant.

In the expansion valve, preferably, a cylindrical portion for guiding a refrigerant ejected from the first throttle toward a wall surface opposite to the first throttle is installed in the refrigerant flow dividing chamber, and flow dividing tube attachment holes are provided in a portion of a sidewall of the refrigerant flow dividing chamber near the first throttle. In this case, a refrigerant flow which has passed the first throttle passes through the inside of the cylindrical portion and is ejected into the refrigerant flow dividing chamber, and then is sprayed onto the wall surface opposite to the first throttle. Thereafter, the refrigerant reverses to flow toward the flow dividing tube attachment hole. As a result, the ejection energy of the refrigerant flow is reduced, and bubbles in the refrigerant are subdivided. Therefore, the flow state of refrigerant flowing into each of the flow dividing tube attachment holes becomes uniform, thereby improving the flow dividing characteristic of the refrigerant.

In the expansion valve, preferably, a helical groove is formed on an outer circumferential surface of the cylindrical portion. In this case, a refrigerant flow sprayed onto the wall surface opposite to the first throttle collides with the wall body, so that the direction of a refrigerant flow is changed. When refrigerant flows between the outer surface of the cylindrical portion and the wall surface of the refrigerant flow dividing chamber, the refrigerant flows, swirled by the helical groove. As a result, the ejection energy of the refrigerant flow is further reduced. Therefore, the ejection energy of the refrigerant flow flowing into each of the flow dividing tube attachment holes is further reduced, and bubbles in a refrigerant are subdivided, thereby improving the flow dividing characteristic of the refrigerant.

In the expansion valve, preferably, a helical groove is formed on an inner circumferential surface of the cylindrical portion. In this case, a refrigerant flow which has passed the first throttle is converted to a swirling flow inside the cylindrical portion and is sprayed onto the wall surface (wall surface opposite to the first throttle) of the refrigerant flow dividing chamber. As a result, the ejection energy of the refrigerant flow is consumed. Accordingly, the ejection energy of a refrigerant flow flowing into each of the flow dividing tube attachment holes is further reduced, and bubbles in the refrigerant are subdivided, thereby improving the flow dividing characteristic of the refrigerant.

In the expansion valve, preferably, in the refrigerant flow dividing chamber, a guide portion for changing the direction of a flow of the refrigerant ejected from the cylindrical portion is formed on a wall surface opposite to the first throttle. In this case, refrigerant is sprayed onto the wall surface of the refrigerant flow divider from the cylindrical portion, so that the direction of the refrigerant flow is smoothly changed. As a result, the ejection energy of the refrigerant flow is further reduced, and bubbles in the refrigerant are subdivided, thereby improving the flow dividing characteristic of the refrigerant.

In the expansion valve, preferably, in the refrigerant flow dividing chamber, a porous permeable layer is installed between the first valve hole and the flow dividing tube attachment hole. In this case, the flow state of refrigerant flowing into each of the flow dividing tube attachment holes becomes uniform by the porous permeable layer, thereby improving the flow dividing characteristic of the refrigerant. The porous permeable layer also prevents the first throttle from being clogged with foreign substances when refrigerant flows in a reverse direction.

In the expansion valve, preferably, the flow dividing tube attachment hole are provided on a wall surface opposite to the first throttle and are disposed at regular intervals along a circumference centering on an axis of the first throttle, and the flow dividing tubes are attached perpendicularly to the wall surface through the flow dividing tube attachment hole. In this case, the flow dividing tube can be disposed along an axis of the expansion valve.

In the expansion valve, preferably, the flow dividing tube attachment holes are formed near the first throttle on a sidewall of the refrigerant flow dividing chamber, and a flow of the refrigerant ejected from the first throttle collides with a wall body opposite to the first throttle, reverses, and then flows into the flow dividing tube. If a flow of the refrigerant ejected from the first throttle flows directly into the flow dividing tube, a turbulence of the refrigerant flow increases, whereby generation of a refrigerant flow noise is increased. Also, when a gas-liquid two-phase flow flows to the expansion valve, a refrigerant flow flowing into the flow dividing tube easily undergoes intermittent fluctuation, and thus it may further generate a refrigerant flow noise and deteriorate the flow dividing characteristic of the refrigerant. In this regard, the present invention, detours a flow of the refrigerant ejected to the refrigerant flow dividing chamber, making it difficult for a flow of the refrigerant ejected from the first throttle to flow directly into the flow dividing tube. That is, a refrigerant flow flowing into the flow dividing tube is less affected by fluctuation of the effects of a gas-liquid two-phase flow flowing into the expansion valve. Also, since the velocity of refrigerant becomes slow at an inlet of the flow dividing tube, the flow dividing characteristic of the refrigerant is improved, and so generation of a refrigerant flow noise is reduced.

Preferably, the expansion valve includes a valve chamber which accommodates the first valve body, and the valve chamber is provided on a downstream side of the first throttle portion, wherein the flow dividing tube attachment holes are formed in a portion of a sidewall of the valve chamber near the first throttle, the valve chamber is opened through the flow dividing tube attached to the flow dividing tube attachment hole, and the valve chamber is also used as the refrigerant flow dividing chamber. In this case, since the valve chamber is also used as the refrigerant flow dividing chamber, the expansion valve can be made smaller. Also, by detouring a flow of the refrigerant ejected from the first throttle, it is possible to ensure that the refrigerant flow does not flow directly into the flow dividing tube. Therefore, the flow dividing characteristic of the refrigerant is improved, and so a refrigerant flow noise is reduced.

In the expansion valve, preferably, the refrigerant flow dividing chamber is formed such that the dimension in a radial direction centering on an axis of the first throttle is greater than the dimension of the axial direction of the first throttle, and the flow dividing tubes attached to the flow dividing tube attachment holes are provided at regular intervals along a circumferential edge in a diametric direction of the refrigerant flow dividing chamber. In this case, it is possible to make it difficult for a flow of the refrigerant ejected from the first throttle to flow directly into the flow dividing tube.

In the expansion valve, preferably, the flow dividing tube attachment holes are provided on a wall body of the refrigerant flow dividing chamber near the first throttle, and the refrigerant flow dividing chamber is opened through the flow dividing tube attached to the flow dividing tube attachment hole. In this case, a refrigerant flow can be more effectively detoured.

In the expansion valve, preferably, the flow dividing tube attachment holes are provided on a wall body opposite to the first throttle, the flow dividing tube is inserted through and fixed into the flow dividing tube attachment holes and the refrigerant flow dividing chamber is opened on a wall near the first throttle. In this case, a detour effect of a refrigerant flow can be obtained, and the flow dividing tube can be disposed along an axis of the expansion valve.

In the expansion valve, preferably, the refrigerant flow dividing chamber is formed in a sector form centering on an axis of the first throttle. Also in this case, the detour effect of a refrigerant described above can be obtained.

In the expansion valve, preferably, a guide portion for widening a flow of the refrigerant ejected from the first throttle in a lateral direction and reversing the refrigerant flow is installed on a wall surface opposite to the first throttle. In this case, it is possible to prevent a turbulence which occurs when the direction of a flow of the refrigerant ejected from the first throttle is changed.

Preferably, the expansion valve includes a valve chamber which accommodates the first valve body, wherein the valve chamber is formed on a downstream side of the first throttle, an inside portion of the valve chamber which is spaced from the first throttle is also used as a refrigerant flow dividing chamber, and a meandering flow generating portion for enabling a refrigerant flow to meander is formed between the refrigerant flow dividing chamber and the first throttle. In this case, since the valve chamber is also used as the refrigerant flow dividing chamber, the expansion valve can be made smaller. Also, since an opening of the flow dividing tube is disposed apart from the first throttle, and a refrigerant ejected from the first throttle meanders, it is possible to ensure a refrigerant flow does not flow directly into the flow dividing tube. Accordingly, the flow dividing characteristic of the refrigerant is improved, and so a refrigerant flow noise is reduced.

In order to achieve the above objects, according to a second aspect of the present invention, there is provided a refrigeration unit utilizing the expansion valve. In this case, a discontinuous refrigerant flow noise in the expansion valve is reduced, whereby the flow dividing characteristic of the refrigerant is improved. Also, the configuration of the refrigeration unit is simplified.

BRIEF DESCRIPTION OF THE DRAWINGS

FIG. 31(*b*) is a cross-sectional view taken along line 31*b*-31*b* of FIG. 31(*a*);

FIG. 31(*c*) is a cross-sectional view taken along line 31*b*-31*b* of FIG. 31(*a*) according to a modification;

FIG. 31(*d*) is a cross-sectional view taken along line 31*b*-31*b* of FIG. 31(*a*) according to a modification;

FIG. 32(*b*) is a bottom view;

FIG. 33(*b*) is a cross-sectional view taken along line 33*b*-33*b* of FIG. 33(*a*);

FIG. 35(*b*) is a bottom view;

FIG. 40(*b*) is a cross-sectional view taken along line 40*b*-40*b* of FIG. 40(*a*);

FIG. 41(*b*) is a cross-sectional view taken along line 41*b*-41*b* of FIG. 41(*a*);

BEST MODE FOR CARRYING OUT THE INVENTION

Figure 1:
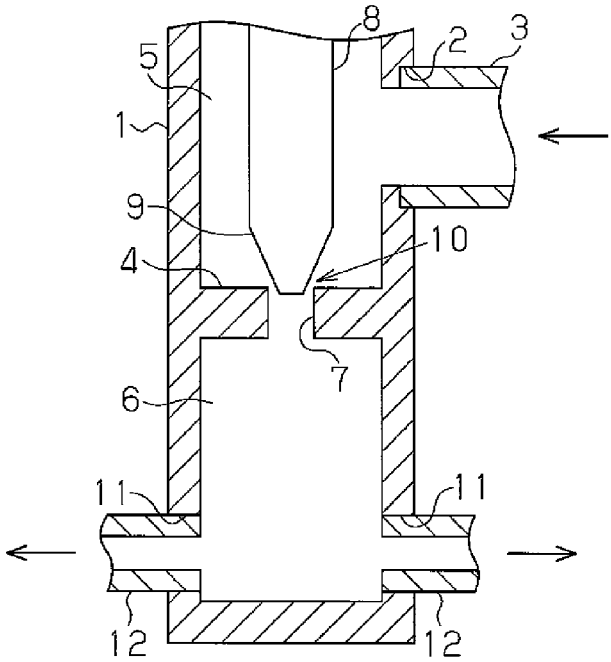
FIG. 1 is a partial longitudinal cross-sectional view illustrating an expansion valve according to a first embodiment of the present invention.

Hereinafter, expansion valves according to embodiments of the present invention will be described with reference to attached drawings. The same reference numerals denote common elements across the embodiments of the present invention. A solid line arrow in the drawings represents a flow of the refrigerant. An expansion valve is used not only to allow a refrigerant to flow in a forward direction but also to allow refrigerant to flow in a reverse direction. For example, an expansion valve is used to allow refrigerant to flow in a forward direction during a cooling operation of an air conditioner and is used to allow refrigerant to flow in a backward direction during a heating operation. For a simplification of a description, in the description below, unless otherwise stated, an expansion valve is used to allow a refrigerant to flow in a forward direction.

First Embodiment

Hereinafter, an expansion valve according to a first embodiment of the present invention will be described with reference to FIG. 1. The expansion valve is used in place of a portion which extends from an expansion valve to a refrigerant flow divider in a refrigerant circuit.

As shown in FIG. 1, the expansion valve has a cylindrical valve body 1. An inlet port 2 is formed on a side surface of the valve body 1. A liquid tube 3 is connected to the inlet port 2. The inside of the valve body 1 is divided into an upper portion and a lower portion by a first partition wall 4, wherein the upper portion (upstream side) is formed as a valve chamber 5, and the lower portion (downstream side) is formed as a refrigerant flow dividing chamber 6. The inlet port 2 is formed on a side surface of the valve chamber 5.

The first partition wall 4 forms a valve seat. A first valve hole 7 is formed at a center of the valve seat. A valve rod 8 is accommodated in the valve chamber 5. The valve rod 8 extends downwardly from a valve driving unit (not shown) and is disposed coaxially with the valve body 1 and the valve chamber 5. A first valve body (needle valve) 9 is formed at a distal end of the valve rod 8. The first valve body 9 is freely moved forward or backward with respect to the first valve hole 7 through the valve rod 8 by the valve driving unit. A first throttle 10 is formed between the valve chamber 5 and the refrigerant flow dividing chamber 6 by the first valve body 9 and the first valve hole 7. The opening degree of the first throttle 10 can be varied according to the magnitude of a refrigeration load.

Flow dividing tube attachment holes 11 of the same number as paths of an evaporator (not shown) are provided in a lower portion of the valve body 1. Each of the flow dividing tube attachment holes 11 are provided at equal pitches along an outer circumferential wall of the valve body 1. A flow dividing tube 12 for connecting the refrigerant flow dividing chamber 6 and each path of the evaporator is connected to each of flow dividing tube attachment holes 11.

In the expansion valve according to the first embodiment of the present invention, when single-phase liquid refrigerant flows to the expansion valve from the inlet port 2, the liquid refrigerant is decompressed in the first throttle 10. The refrigerant decompressed in the first throttle 10 is converted to a low-pressure gas-liquid two-phase flow and is sprayed to the refrigerant flow dividing chamber 6 from the first throttle 10. As a result, the refrigerant is uniformly divided in the refrigerant flow dividing chamber 6 with respect to each of the flow dividing tubes 12 without being influenced by gravity.

Also, when the refrigerant flows to the expansion valve with a slug flow or a plug flow, the liquid refrigerant and the gaseous refrigerant (bubbles) alternately flow through the first throttle 10. For this reason, the velocity and pressure of the refrigerant flow are apt to fluctuate in the expansion valve. In addition, due to the velocity fluctuation and the pressure fluctuation of the refrigerant flow, the refrigerant flow noise is apt to occur in the expansion valve. However, according to the present embodiment, the refrigerant flow dividing chamber 6 is formed on the downstream side of the first throttle 10 to expand a refrigerant flow passage. In this case, since the ejection energy of the refrigerant flow is dispersed in the refrigerant flow dividing chamber 6, the velocity fluctuation and the pressure fluctuation of the refrigerant flow are mitigated to thereby reduce the discontinuous refrigerant flow noise. Also, since the refrigerant is sprayed to the refrigerant flow dividing chamber 6 from the first throttle 10, the refrigerant is uniformly divided with respect to each of the flow dividing tubes 12 without being influenced by gravity.

In addition, since the opening degree of the first throttle 10 can be varied according to a refrigeration load, unlike the conventional refrigerant flow divider which has a throttle with a constant opening degree, the throttling degree is appropriately adjusted depending on an operating condition such as a flow rate and a drying degree, whereby the flow dividing characteristic of refrigerant is further improved.

Also, in the expansion valve according to the first embodiment of the present invention, since the expansion valve and the refrigerant flow divider are integrally formed with each other, the structure of a portion which extends from the expansion valve to the refrigerant flow divider is simplified, whereby the layout size is reduced. Also, the expansion valve according to the present embodiment includes the valve chamber 5 on the upstream side of the first throttle 10 and the refrigerant flow dividing chamber 6 at a downstream side thereof. In this case, the refrigerant flow dividing chamber 6 is designed while maintaining the structure of the conventional valve chamber. This adds to the flexibility of design of the refrigerant flow dividing chamber 6.

The expansion valve may be used, for example, in a heat pump-type refrigeration circuit of a heating-cooling double purpose which allows refrigerant to reversely flow. In such a refrigerant circuit, when refrigerant flows in a reverse direction, a high-pressure liquid refrigerant flows to the refrigerant flow dividing chamber 6 from each of the flow dividing tubes 12. That is, during a heating operation, a heat exchanger which is used as an evaporator during a cooling operation is used as a condenser. While the condenser is connected to an upstream side of the refrigerant flow divider, the expansion valve is driven to control an excessive cooling degree of a high-pressure liquid refrigerant flowing in from the condenser. Since refrigerant is stored in a heat exchanger whose operation is suspended in a gas-liquid two-phase state, a gas-liquid two-phase refrigerant may flow to the expansion valve for several minutes when a heating operation starts. For this reason, a high-pressure liquid refrigerant flows to the refrigerant flow dividing chamber 6 with a plug flow or a slug flow, so that a discontinuous refrigerant flow noise may occur. However, in the expansion valve according to the present embodiment, a refrigerant which flows to the refrigerant flow dividing chamber 6 from the flow dividing tubes 12 is shaken up, so that bubbles in the refrigerant flow are subdivided. Therefore, even though the refrigerant flows in a reverse direction in the expansion valve, a discontinuous refrigerant flow noise is effectively reduced.

Second Embodiment

Next, an expansion valve according to a second embodiment of the present invention will be described with reference to FIG. 2.

Figure 2:
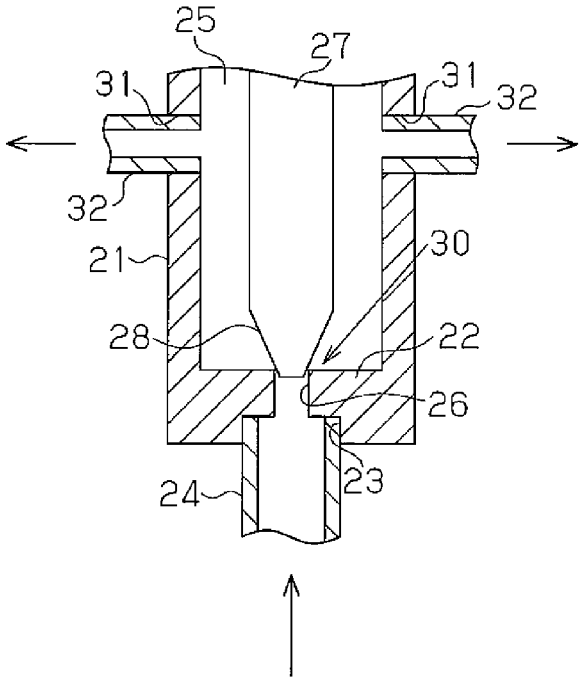
FIG. 2 is a partial longitudinal cross-sectional view illustrating an expansion valve according to a second embodiment of the present invention.

As shown in FIG. 2, the expansion valve has a cylindrical valve body 21. An inlet port 23 is formed in a lower wall 22 of the valve body 21. A liquid tube 24 is connected to the inlet port 23. A space inside the valve body 21 is formed as an operation chamber 25 which serves as both a valve chamber accommodating a valve body and a refrigerant flow dividing chamber dividing a refrigerant flow.

A valve seat is formed in the lower wall 22. The inlet port 23 and a first valve hole 26 are formed in a center of the valve seat. A valve rod 27 is accommodated in the operation chamber 25 inside the valve body 21. The valve rod 27 extends downwardly from a valve driving unit and is disposed coaxially with the valve body 21 and the operation chamber 25. A first valve body (needle valve) 28 is formed at a distal end of the valve rod 27. The first valve body 28 is freely moved forward or backward with respect to the first valve hole 26 through the valve rod 27 by the valve driving unit. A first throttle 30 is formed between the lower wall 22 and the operation chamber 25 by the first valve body 28 and the first valve hole 26. The opening degree of the first throttle 30 can be varied according to the magnitude of a refrigeration load.

Flow dividing tube attachment holes 31 of the same number as paths of an evaporator (not shown) are installed in an upper portion of the valve body 21. Each of the flow dividing tube attachment holes 31 is provided at equal pitches along an outer circumferential wall of the valve body 21. A flow dividing tube 32 for connecting the operation chamber 25 and each path of the evaporator is attached to each of flow dividing tube attachment holes 31.

In the expansion valve according to the second embodiment of the present invention, when single-phase liquid refrigerant flows to the expansion valve from the inlet port 23, the liquid refrigerant is decompressed in the first throttle 30. The refrigerant decompressed in the first throttle 30 is converted to a low-pressure gas-liquid two-phase flow and is sprayed to the operation chamber 25 from the first throttle 30. As a result, the refrigerant is uniformly divided in the operation chamber 25 with respect to each flow dividing tube 32 without being influenced by gravity.

Also, when the refrigerant flows to the expansion valve with a slug flow or a plug flow, the liquid refrigerant and the gaseous refrigerant (bubbles) alternately flow through the first throttle 30. For this reason, the velocity and pressure of the refrigerant flow are apt to fluctuate in the expansion valve, so that the refrigerant flow noise is apt to occur in the expansion valve. However, according to the present embodiment, the operation chamber 25 is formed on the downstream side of the first throttle 30 to expand a refrigerant flow passage. Therefore, the ejection energy of the refrigerant flow is dispersed in the operation chamber 25. As a result, the velocity fluctuation and the pressure fluctuation of the refrigerant flow which is directed from the operation chamber 25 into the flow dividing tube 32 are mitigated to thereby reduce the discontinuous refrigerant flow noise. Also, the refrigerant flows into the operation chamber 25 by being sprayed from the first throttle 30. As a result, the refrigerant is uniformly divided with respect to each flow dividing tube 32 without being influenced by gravity.

In addition, since the opening degree of the first throttle 30 can be varied according to a refrigeration load, unlike the conventional refrigerant flow divider which has a throttle with a constant opening degree, the throttling degree is appropriately adjusted depending on an operating condition such as a flow rate and a drying degree, whereby the flow dividing characteristic of refrigerant is further improved.

Also, in the expansion valve according to the second embodiment of the present invention, since the expansion valve and the refrigerant flow divider are integrally formed with each other, the structure of a portion which extends from the expansion valve to the refrigerant flow divider is simplified, whereby the layout size is reduced. Also, in the expansion valve according to the present embodiment, since a space containing a refrigerant flow dividing chamber is formed in the valve chamber as an operation chamber, the structure is further simplified than that of the first embodiment of the present invention.

The expansion valve may be used, for example, in a heat pump-type refrigeration circuit for both heating and cooling which allows a refrigerant to reversely flow. In such a refrigerant circuit, when refrigerant flows in a reverse direction, a high-pressure liquid refrigerant flows to the operation chamber 25 from a plurality of flow dividing tubes 32. As described in the first embodiment of the present invention, when a high-pressure liquid refrigerant flows to the expansion valve with a plug flow or a slug flow when an operation starts, refrigerant is shaken up when it flows to the operation chamber 25 from the flow dividing tube 32, so that bubbles in the refrigerant flow are subdivided. Therefore, even though the refrigerant flows in a reverse direction in the expansion valve, a discontinuous refrigerant flow noise is effectively reduced.

Third Embodiment

Next, an expansion valve according to a third embodiment of the present invention will be described with reference to FIG. 3.

Figure 3:
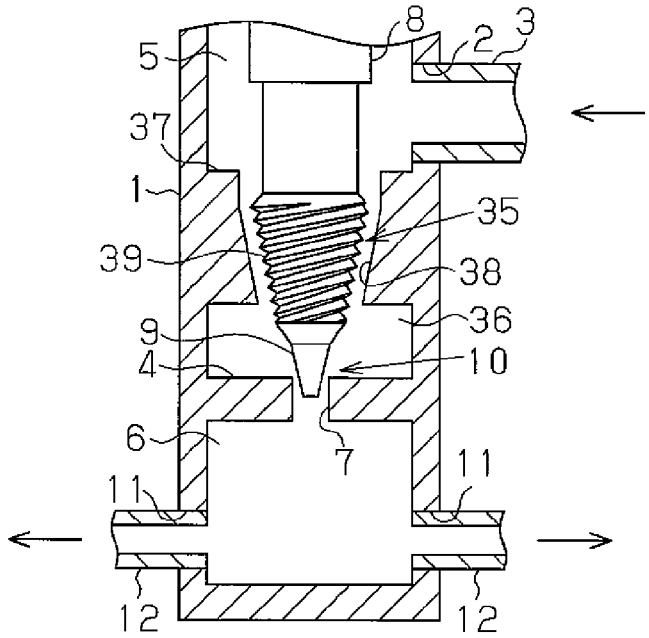
FIG. 3 is a partial longitudinal cross-sectional view illustrating an expansion valve according to a third embodiment of the present invention.

As shown in FIG. 3, the expansion valve includes a second throttle 35 inside a valve chamber 5 as bubble subdividing means and includes an enlarged space portion 36 between the second throttle 35 and a first throttle 10. The expansion valve includes a second partition wall 37 at a center of the valve chamber 5. The enlarged space portion 36 is disposed below the second partition wall 37, i.e., between the second partition wall 37 and the first throttle 10. A tapered hole whose diameter becomes smaller downwardly is formed at a center of the second partition wall 37. The tapered hole forms a second valve hole 38. A valve rod 8 is disposed coaxially with a valve body 1. The valve rod 8 has an enlarged diameter portion as a second valve body 39 disposed above a first valve body 9, i.e., at a center of the valve rod 8. An outer circumferential surface of the second valve body 39 is a tapered surface whose outer diameter becomes smaller downwardly. A helical groove is formed on an outer circumferential surface of the second valve body 39. The helical groove forms a helical passage between a wall surface forming the second valve hole 38 and the second valve body 39. In the present embodiment, the helical passage serves as the second throttle 35. In the second throttle 35, as the valve rod 8 moves in a vertical direction, the cross-sectional area and the length of the helical passage vary. For example, when a refrigeration load is small, the valve rod 8 moves downwardly so that the cross-sectional area of the helical passage becomes small and the helical passage becomes long. As a result, the opening degree of the first throttle 10 formed between the first valve hole 7 and the second valve body 9 decreases, so that flow resistance of a refrigerant which flows through the first throttle 10 increases. As described above, the opening degree of the first throttle 10 can be changed by a vertical movement of the valve rod 8.

In the expansion valve of the third embodiment of the present invention, as with the first embodiment of the present invention, a refrigerant flow dividing chamber 6 is formed in the lower portion (at a downstream side) of a first partition wall 4. For this reason, the same operation effect as the first embodiment of the present invention is obtained. In addition, since the second throttle 35 and the enlarged space portion 36 are formed inside the valve chamber 5 in the upper portion (at an upstream side) of the first partition wall 4, the following operation effects are obtained.

In the first embodiment, when refrigerant flows to the expansion valve from the inlet port 2 with a slug flow or a plug flow, bubbles in a refrigerant flow are not subdivided while passing through the first throttle 10. However, in the present embodiment, bubbles in a refrigerant flow which flows in from the inlet port 2 are subdivided when passing through the second throttle 35, and so a refrigerant smoothly flows to the first throttle 10, thereby effectively reducing a discontinuous refrigerant flow noise. Particularly, since the second throttle 35 is formed of a helical passage, a throttle passage can be easily made longer, whereby a subdivision of bubbles is further promoted.

In the present embodiment, since a two-step throttle is formed by the second throttle 35 and the first throttle 10, the ejection energy of a refrigerant flow is further reduced by each throttle. Therefore, the velocity fluctuation and the pressure fluctuation of a refrigerant flow which passes through the expansion valve are mitigated. Also, in the third embodiment of the present invention, since the enlarged space portion 36 is installed in addition to the second throttle 35, the ejection energy of a refrigerant flow is dispersed in the enlarged space portion 36 after passing through the second throttle 35. Therefore, compared to a case of having only the second throttle 35, a subdivision effect of bubbles is further improved, and the velocity fluctuation and the pressure fluctuation of a refrigerant flow are further mitigated. Accordingly, the occurrence of a discontinuous refrigerant flow noise is further reduced than the first embodiment.

Fourth Embodiment

Next, an expansion valve according to a fourth embodiment of the present invention will be described with reference to FIG. 4.

Figure 4:
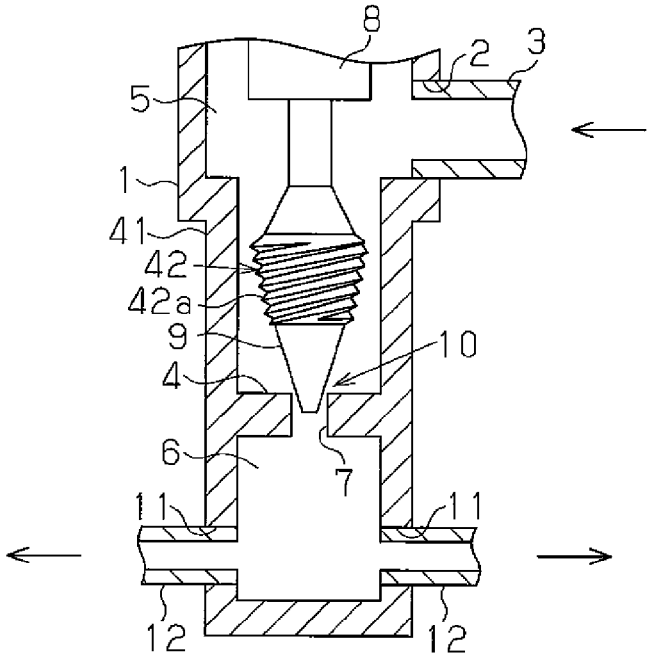
FIG. 4 is a partial longitudinal cross-sectional view illustrating an expansion valve according to a fourth embodiment of the present invention.

As shown in FIG. 4, the expansion valve includes a turbulence generating portion for generating a turbulent flow in a refrigerant flow inside a valve chamber 5 as bubble subdividing means. The fourth embodiment is the same as the third embodiment in that the bubble subdividing means is provided inside the valve chamber 5, but it is different from the third embodiment in the structure of the bubble subdividing means. The expansion valve includes a small diameter portion 41 whose outer dimension is small below the valve chamber 5. A portion of a valve rod 8 corresponding to the small diameter portion 41 is formed as the turbulent flow generating portion. The turbulent flow generating portion swirls a refrigerant flow flowing into a first throttle 10. The turbulent flow generating portion includes an enlarged diameter portion 42 formed at a central location of the valve rod 8 and a helical groove 42*a* formed on an outer circumferential surface of the enlarged diameter portion 42. In the fourth embodiment of the present invention, an inner surface of the small diameter portion 41 is not a tapered. For this reason, the gap between the enlarged diameter portion 42 and the small diameter portion 41 is not reduced enough to cause a throttling operation. Refrigerant flowing along a circumference of the enlarged diameter portion 42 is swirled by the helical groove 42*a* and thus shaken up, but it does not undergo a throttling operation.

In the expansion valve according to the fourth embodiment of the present invention, when refrigerant flows to the expansion valve from an inlet port 2 with a slug flow or a plug flow, a refrigerant flow is swirled, flowing along a circumference of the enlarged diameter portion 42. A refrigerant flow is shaken up due to the swirling, so that bubbles in a refrigerant flow are subdivided, thereby reducing a discontinuous refrigerant flow noise.

Fifth Embodiment

Next, an expansion valve according to a fifth embodiment of the present invention will be described with reference to FIG. 5.

Figure 5:
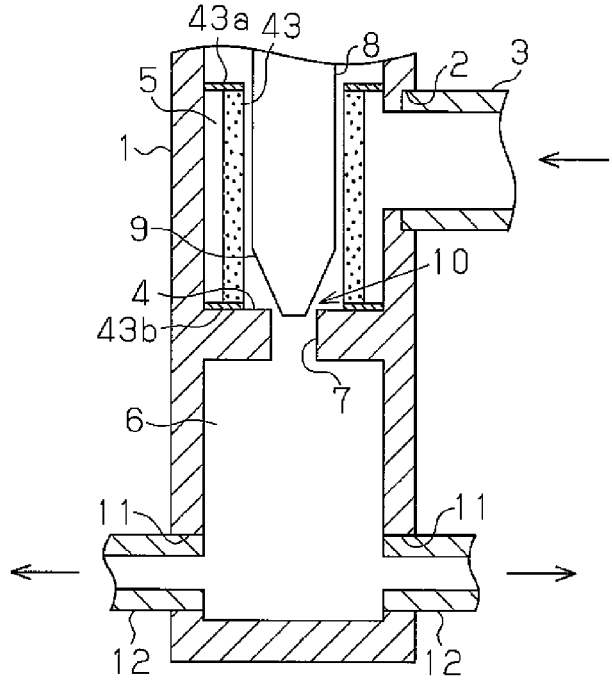
FIG. 5 is a partial longitudinal cross-sectional view illustrating an expansion valve according to a fifth embodiment of the present invention.

As shown in FIG. 5, the expansion valve includes a porous permeable layer 43 inside a valve chamber 5 as bubble subdividing means. In the expansion valve according to the fifth embodiment of the present invention, the porous permeable layer 43 substitutes for the bubble subdividing means of the third and fourth embodiments. The porous permeable layer 43 is a cylindrical body surrounding an outer circumferential surface of a valve rod 8 and extends from a top surface of a first partition wall 4 to an upper portion of an inlet port 2. The porous permeable layer 43 is supported to an inner surface of the valve chamber 5 at the top end and the bottom end thereof by support plates 43*a* and 43*b*. The porous permeable layer 43 is made of a material such as metal foam, ceramic, resin foam, mesh, and a porous plate.

In the expansion valve according to the fifth embodiment of the present invention, when refrigerant flows to the expansion valve from an inlet port 2 with a slug flow or a plug flow, bubbles in a refrigerant flow are subdivided while passing through the porous permeable layer 43, so that a discontinuous refrigerant flow noise is reduced. The porous permeable layer 43 removes foreign substances in a refrigerant and so also serves as a filter.

Sixth Embodiment

Next, an expansion valve according to a sixth embodiment of the present invention will be described with reference to FIG. 6.

Figure 6:
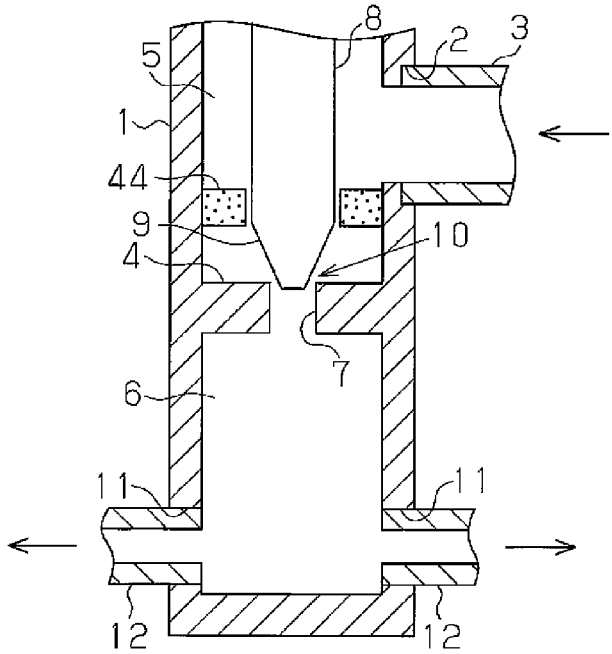
FIG. 6 is a partial longitudinal cross-sectional view illustrating an expansion valve according to a sixth embodiment of the present invention.

As shown in FIG. 6, the expansion valve is one in which the shape of the porous permeable layer of the fifth embodiment of the present invention as bubble subdividing means is modified. The expansion valve includes a porous permeable layer 44 inside a valve chamber 5. The porous permeable layer 44 is a plate-shaped torus and is installed near an inlet port 2 to fill the gap between a valve rod 8 and an inner surface of a valve body 1. Materials of the porous permeable layer 44 are the same as those of the fifth embodiment.

In the expansion valve according to the sixth embodiment of the present invention, when refrigerant flows to the expansion valve from an inlet port 2 with a slug flow or a plug flow, bubbles in a refrigerant flow are subdivided while passing through the porous permeable layer 44, so that a discontinuous refrigerant flow noise is reduced. The porous permeable layer 44 removes foreign substances in a refrigerant and so also serves as a filter.

Seventh Embodiment

Next, an expansion valve according to a seventh embodiment of the present invention will be described with reference to FIG. 7.

Figure 7:
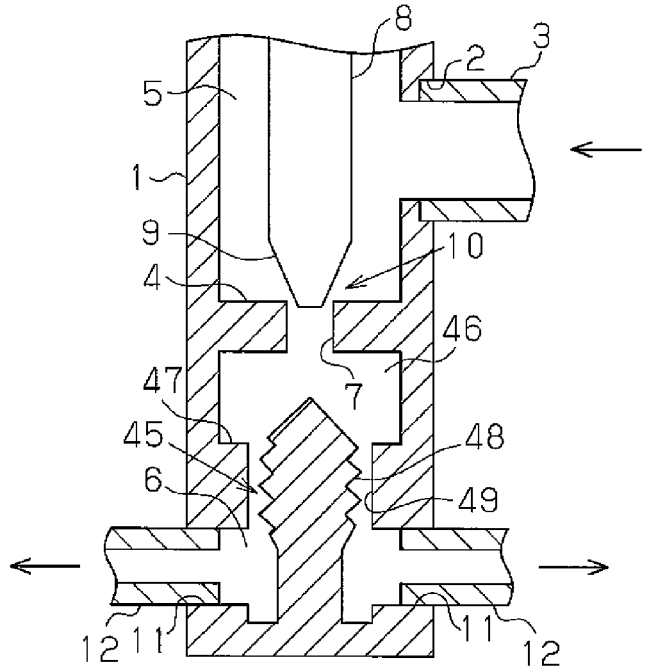
FIG. 7 is a partial longitudinal cross-sectional view illustrating an expansion valve according to a seventh embodiment of the present invention.

As shown in FIG. 7, the expansion valve includes a third throttle 45 on the downstream side of a first throttle 10 and an enlarged space portion 46 between the third throttle 45 and the first throttle 10. The expansion valve includes a third partition wall 47 on the downstream side of the first throttle 10. The enlarged space portion 46 is disposed above the third partition wall 47, i.e., between the third partition wall 47 and the first throttle 10. A refrigerant flow dividing chamber 6 is installed on the downstream side of the third partition wall 47. A through hole which a third valve body 48 passes through is formed at a center of the third partition wall 47. The through hole is a hole which extends linearly along the axis of the valve rod 8 and forms a third valve hole 49. A turbulent flow generating member protrudes from the bottom surface of the refrigerant flow dividing chamber 6. An upper portion of the turbulent flow generating member forms the third valve body 48. The third valve body 48 is a portion which corresponds to the third valve hole 49 of the turbulent flow generating member. The third valve body 48 is a cylindrical body whose outer circumferential surface has a helical groove. The third valve body 48 and a wall surface of the third valve hole 49 are apart from each other at a predetermined distance. A helical passage is formed between the third valve body 48 and a wall surface of the third valve hole 49. The helical passage forms the third throttle 45 with a constant opening degree.

In the expansion valve according to the seventh embodiment of the present invention, when a high-pressure single-phase liquid refrigerant flows to the expansion valve from an inlet port 2, the high-pressure liquid refrigerant is decompressed in the first throttle 10 and the third throttle 45 and is sprayed to the refrigerant flow dividing chamber 6 from the first throttle 10. As a result, the refrigerant is uniformly divided in the refrigerant flow dividing chamber 6 with respect to each of the flow dividing tubes 12 without being influenced by gravity.

Also, when refrigerant flows to the expansion valve with a slug flow or a plug flow, liquid refrigerant and gaseous refrigerant alternately flow through the first throttle 10. For this reasons the velocity fluctuation and the pressure fluctuation of the refrigerant flow easily occur, so that a discontinuous refrigerant flow noise is apt to occur in the first throttle 10. However, according to the present embodiment, the enlarged space portion 46 is formed on the downstream side of the first throttle 10. Therefore, the ejection energy of a refrigerant flow is dispersed in the enlarged space portion 46, whereby the ejection energy of a refrigerant flow is reduced. Also, since a two-step throttle in which the first throttle 10 and the third throttle 45 are serially disposed is provided, the ejection energy of a refrigerant flow is effectively reduced by each throttle. In addition, since the third throttle 45 includes a helical passage, the direction of a refrigerant flow becomes uniform while a refrigerant passes through the passage. Further, a refrigerant passes through the third throttle 45 and is then ejected to the refrigerant flow dividing chamber 6 which is the enlarged space portion. Accordingly, the ejection energy of a refrigerant flow is dispersed.

As described above, according to the present embodiment, the passage enlarging operation by the enlarged space portion 46 and the refrigerant flow dividing chamber 6, the flow rectifying operation by the third throttle, and the two-step throttling operation by the first and third throttles 10 and 45 are performed, so that the ejection energy of a refrigerant flow is reduced, whereby the velocity fluctuation and the pressure fluctuation of a refrigerant flow are mitigated. As a result, a discontinuous refrigerant flow noise is effectively reduced. Also, bubbles in a refrigerant flow are ejected to the enlarged space portion 46 from the first throttle 10 and is then subdivided by the third throttle 45 with the helical passage. Therefore, the flow dividing characteristic of the refrigerant of the refrigerant flow dividing chamber is further improved.

Eighth Embodiment

Next, an expansion valve according to an eighth embodiment of the present invention will be described with reference to FIG. 8.

Figure 8:
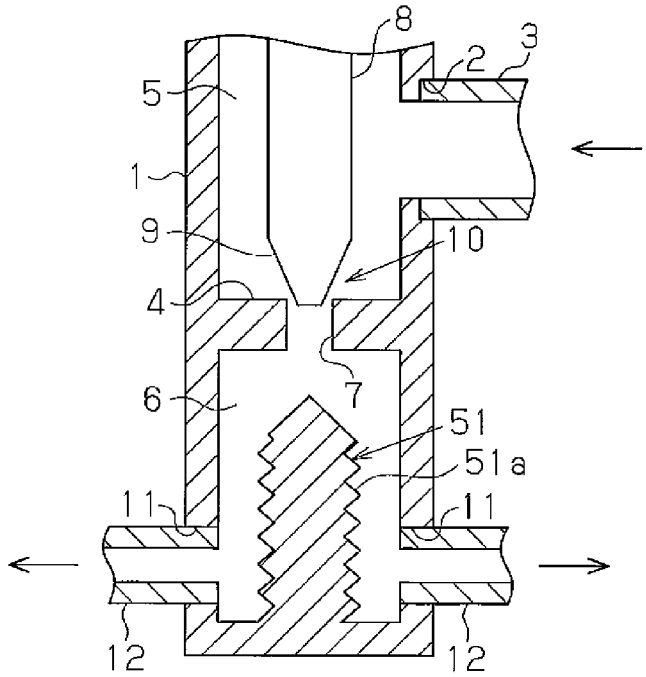
FIG. 8 is a partial longitudinal cross-sectional view illustrating an expansion valve according to an eighth embodiment of the present invention.

As shown in FIG. 8, the expansion valve includes a turbulent flow generating member 51 inside a refrigerant flow dividing chamber 6, i.e., on the downstream side of a first throttle 10. A helical groove 51*a* for swirling a refrigerant flow is formed on an outer circumferential surface of the turbulent flow generating member 51. The turbulent flow generating member 51 protrudes upwardly from the bottom surface of the refrigerant flow dividing chamber 6 and is disposed coaxially with a first valve hole 7. The turbulent flow generating member 51 is a cylindrical body and the top end portion thereof is conical. Flow dividing tube attachment holes 11 are formed in a lower portion of a valve body 1.

In the expansion valve according to the eighth embodiment of the present invention, when a high-pressure liquid refrigerant of a single liquid phase flows to the expansion valve from an inlet port 2, similar effects as the first embodiment of the present invention are obtained. Also, when refrigerant flows to the expansion valve with a slug flow or a plug flow, a passage in the refrigerant flow dividing chamber 6 is enlarged, so that the ejection energy of a refrigerant flow is dispersed. In addition, a refrigerant flow is converted to a swirling flow by the helical groove 51*a* of the turbulent flow generating member 51 after passing through the first throttle 10. As a result, the ejection energy of the refrigerant flow is reduced, and the velocity fluctuation and the pressure fluctuation of a refrigerant flow are mitigated, whereby a discontinuous refrigerant flow noise is reduced.

Furthermore, after being ejected to the refrigerant flow dividing chamber 6 from the first throttle 10, bubbles in the refrigerant are subdivided by dispersion of the ejection energy resulting from passage enlargement of the refrigerant flow dividing chamber 6 and swirling effect when flowing along the turbulent flow generating member 51. Therefore, the flow dividing characteristic of the refrigerant is further improved.

Ninth Embodiment

Next, an expansion valve according to a ninth embodiment of the present invention will be described with reference to FIG. 9.

Figure 9:
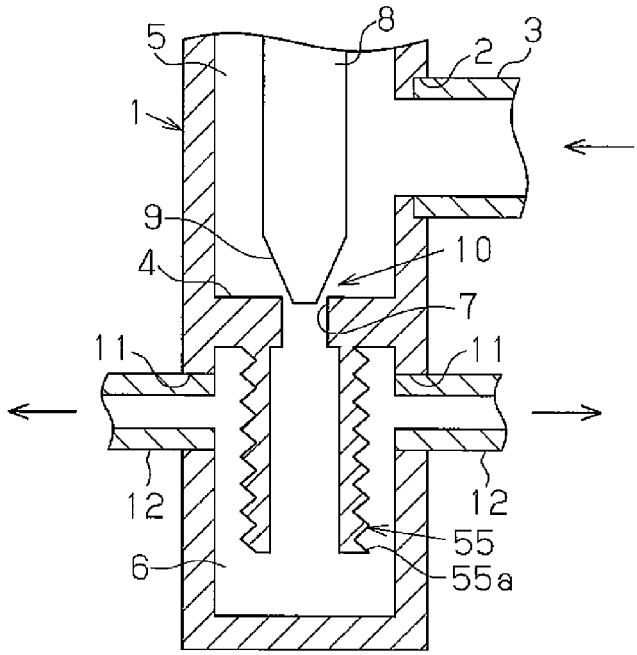
FIG. 9 is a partial longitudinal cross-sectional view illustrating an expansion valve according to a ninth embodiment of the present invention.

As shown in FIG. 9, the expansion valve is one in which a cylindrical portion 55 substitutes for the turbulent flow generating member 51 of the eighth embodiment of the present invention. The expansion valve includes a refrigerant flow dividing chamber 6 on the downstream side of a first throttle 10. The cylindrical portion 55 for producing a turbulent flow in a refrigerant flow is installed on the downstream side of the first throttle 10. The cylindrical portion 55 protrudes downwardly from the bottom surface of a first partition wall 4 and is disposed coaxially with a first valve hole 7. The inside diameter of the cylindrical portion 55 is set to be larger than that of the first valve hole 7. A helical groove 55*a* is formed on an outer circumferential surface of the cylindrical portion 55. A lower end portion of the cylindrical portion 55 extends to a wall surface opposite to the first throttle 10, i.e., to a portion near an inner surface of a wall body of a valve body 1. Flow dividing tube attachment holes 11 are provided on a sidewall of the valve body 1 and are disposed near the first valve hole 7, i.e., in an upper portion of the refrigerant flow dividing chamber 6.

In the expansion valve according to the ninth embodiment of the present invention, when a high-pressure liquid refrigerant of a single liquid phase flows to the expansion valve from an inlet port 2, similar effects as the first embodiment of the present invention are obtained. Also, when refrigerant flows to the expansion valve from the inlet port 2 with a slug flow or a plug flow, refrigerant is ejected into the cylindrical portion 55 from the first throttle 10. After passing through the cylindrical portion 55, the refrigerant is ejected into the refrigerant flow dividing chamber 6. Thereafter, the refrigerant collides with the bottom surface of the refrigerant flow dividing chamber 6, so that the direction of the refrigerant flow is changed from downward to upward. Then, the refrigerant flow passes through between the cylindrical portion 55 and an inner circumferential surface of the refrigerant flow dividing chamber 6 and is then divided with each of the flow dividing tubes 12 while undergoing a swirling operation by the helical groove 55*a* of the cylindrical portion 55. In this case, due to a passage enlarging operation when flowing from the cylindrical portion 55 to the refrigerant flow dividing chamber 6, a flow direction changing operation below the cylindrical portion 55, and a swirling operation by the helical groove 55*a*, the ejection energy of a refrigerant flow is reduced, so that bubbles in a refrigerant flow are subdivided. As a result, the velocity fluctuation and the pressure fluctuation of a refrigerant flow are mitigated, so that a discontinuous refrigerant flow noise is reduced, and the flow dividing characteristic of the refrigerant is further improved.

Tenth Embodiment

Next, an expansion valve according to a tenth embodiment of the present invention will be described with reference to FIG. 10.

Figure 10:
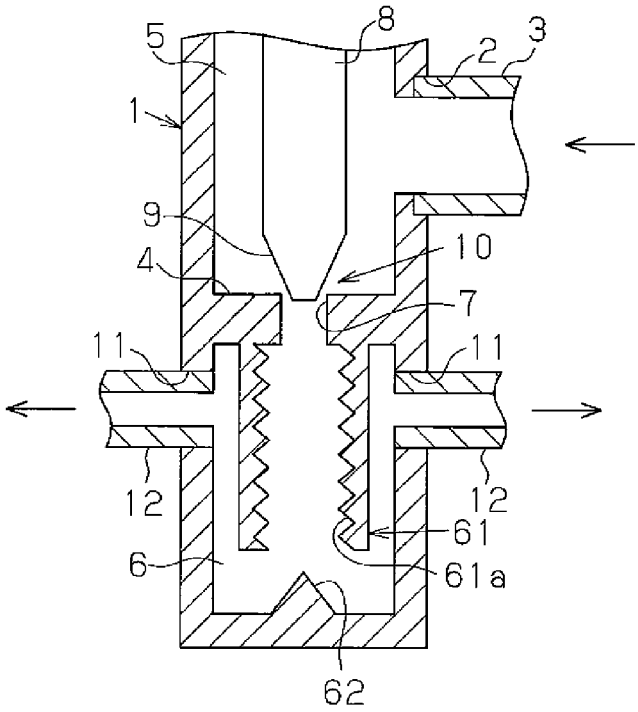
FIG. 10 is a partial longitudinal cross-sectional view illustrating an expansion valve according to a tenth embodiment of the present invention.

As shown in FIG. 10, the expansion valve is one in which the structure of the cylindrical portion of the ninth embodiment of the present invention is modified and includes a guide portion for reversing the direction of a flow of the refrigerant ejected from the cylindrical portion. A cylindrical portion 61 extends downwardly from the bottom surface of a partition wall 4 and is disposed coaxially with a first valve hole 7. Unlike the cylindrical portion of the ninth embodiment, a helical groove 61*a* is formed on an inner circumferential surface of the cylindrical portion 61. A guide portion 62 is installed on a wall surface opposite to a first throttle 10. The guide portion 62 serves to reverse the direction of a flow of the refrigerant ejected from the cylindrical portion 61. The guide portion 62 includes a conical protruding portion installed coaxially with the cylindrical portion 61.

In the expansion valve according to the tenth embodiment of the present invention, when refrigerant flows to the expansion valve from an inlet port 2 with a slug flow or a plug flow, refrigerant is ejected into the cylindrical portion 61 from a first throttle 10 and then undergoes a swirling operation by the helical groove 61*a* inside the cylindrical portion 61. As a result, refrigerant is converted to a swirling flow to be ejected toward the bottom surface of a refrigerant flow dividing chamber 6. The refrigerant flow collides with the bottom surface of the refrigerant flow dividing chamber 6, so that the direction of the refrigerant flow is smoothly changed from downward to upward by the guide portion 62. Thereafter, the refrigerant flow passes through between the cylindrical portion 61 and an inner circumferential surface of a valve body 1 and is then divided with respect to each of the flow dividing tubes 12. In this case, a refrigerant undergoes a swirling operation by the helical groove 61*a* when flowing into the refrigerant flow dividing chamber 6 from the cylindrical portion 61, a passage enlarging operation by the refrigerant flow dividing chamber 6, and a flow direction changing operation by the guide portion 62. As a result, the ejection energy of a refrigerant flow is reduced, and bubbles in the refrigerant flow are subdivided. Therefore, the velocity fluctuation and the pressure fluctuation of a refrigerant flow are mitigated, so that a discontinuous refrigerant flow noise is reduced, and the flow dividing characteristic of the refrigerant is further improved.

Eleventh Embodiment

Next, an expansion valve according to an eleventh embodiment of the present invention will be described with reference to FIG. 11.

Figure 11:
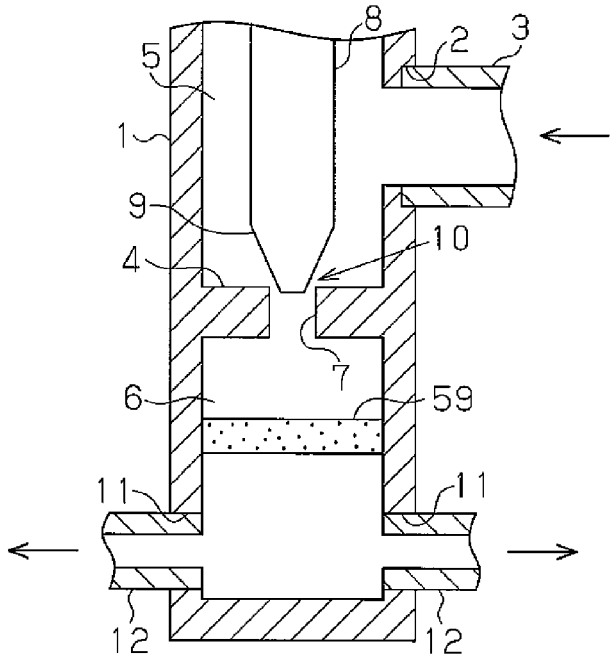
FIG. 11 is a partial longitudinal cross-sectional view illustrating an expansion valve according to an eleventh embodiment of the present invention.

As shown in FIG. 11, the expansion valve includes a porous permeable layer 59 inside a refrigerant flow dividing chamber 6, i.e., on the downstream side of a first throttle 10. The expansion valve includes the refrigerant flow dividing chamber 6 on the downstream side of the first throttle 10. The disk-shaped porous permeable layer 59 is installed inside the refrigerant flow dividing chamber 6. The porous permeable layer 59 is made of a material such as metal foam, ceramic, resin foam, mesh, and a porous plate.

In the expansion valve according to the eleventh embodiment of the present invention, a refrigerant flow is ejected to the refrigerant flow dividing chamber 6 after passing through the first throttle 10. As a result, the ejection energy of a refrigerant flow is dispersed. Thereafter, a refrigerant flow passes through the porous permeable layer 59. At this time, the ejection energy of a refrigerant flow is consumed, and bubbles in a refrigerant are subdivided, so that liquid refrigerant is mixed with bubbles. Therefore, when refrigerant flows to the expansion valve from an inlet port 2 with a slug flow or a plug flow, the velocity fluctuation and the pressure fluctuation of a refrigerant flow are mitigated, so that a discontinuous refrigerant flow noise is reduced. Also, since a flowing state of a gas-liquid two-phase flow directing toward each of the flow dividing tube attachment holes 11 becomes uniform, the flow dividing characteristic of the refrigerant is improved. Also, when refrigerant flows in a reverse direction, foreign substances in a refrigerant are removed by the porous permeable layer 59, and the first throttle 10 is prevented from being clogged.

Twelfth Embodiment

Next, an expansion valve according to a twelfth embodiment of the present invention will be described with reference to FIG. 12.

Figure 12:
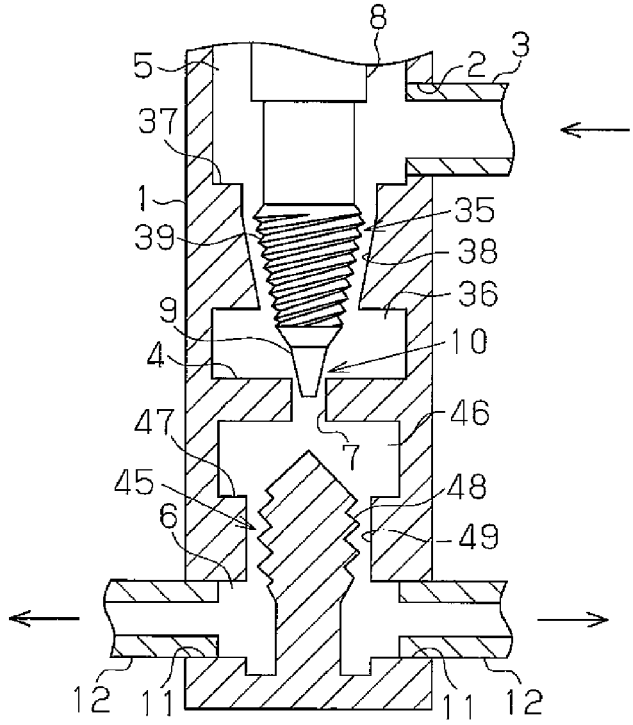
FIG. 12 is a partial longitudinal cross-sectional view illustrating an expansion valve according to a twelfth embodiment of the present invention.

As shown in FIG. 12, in the expansion valve, an upstream side of a first throttle 10 is the same as that of the third embodiment, and a downstream side of the first throttle 10 is the same as that of the seventh embodiment. A second partition wall 37 is installed in a central portion of a valve chamber 5. An enlarged space portion 36 is formed between the second partition wall 37 and the first throttle 10. A tapered second valve hole 38 is formed at a center of the second partition wall 37, and a tapered second valve body 39 is formed in an intermediate portion of a valve rod 8. A helical passage is formed between an inner surface of a second valve hole 38 and an outer circumferential surface of the second valve body 39 as a second throttle 35.

A third partition wall 47 is installed on the downstream side of the first throttle 10. An enlarged space portion 46 is formed between the third partition wall 47 and the first throttle 10. A third valve hole 49 which extends linearly along the axis of a valve rod 8 is formed at a center of the third partition wall 47. A turbulent flow generating member which extends upwardly is installed in a lower portion of a refrigerant flow dividing chamber 6. A third valve body 48 is formed as an upper portion of the turbulent flow generating member. The third valve body 48 is a cylindrical body and has a helical groove formed on its outer circumferential surface. A helical passage is formed between an inner surface of the third valve hole 49 and an outer circumferential surface of the third valve body 48 as the third throttle 45.

In the expansion valve according to the twelfth embodiment of the present invention, when a high-pressure liquid refrigerant of a single liquid phase flows to the expansion valve from an inlet port 2, a high-pressure liquid refrigerant is decompressed by the second throttle 35, the first throttle 10 and the third throttle 45 to be sprayed to the refrigerant flow dividing chamber 6. Therefore, refrigerant is uniformly divided in the refrigerant flow dividing chamber 6 with respect to each flow dividing tube 12 without being influenced by gravity.

Also, when refrigerant flows to the expansion valve with a slug flow or a plug flow, a refrigerant undergoes a throttling operation by the second throttle 35 and a passage enlarging operation by the enlarged space portion 36. As a result, bubbles in a refrigerant are subdivided, and so liquid refrigerant and gaseous refrigerant alternately flow through the first throttle 10, whereby a discontinuous refrigerant flow is mitigated. Also, since a passage is enlarged in the enlarged space portion 46 after refrigerant is ejected from the first throttle 10, the ejection energy of a refrigerant flow is dispersed. Also, since a three-step throttle in which the second throttle 35, the first throttle 10 and the third throttle 45 are serially disposed is provided, the ejection energy of a refrigerant flow is effectively reduced. Also, since the third throttle 45 has a helical passage, the direction of a refrigerant flow becomes uniform. As a result, the velocity fluctuation and the pressure fluctuation of a refrigerant flow are mitigated, whereby a discontinuous refrigerant flow noise is reduced. Also, due to the passage enlarging operation by the enlarged space portion 46 and the three-step throttling operation, bubbles in a refrigerant flow are further subdivided, whereby the flow dividing characteristic of the refrigerant is further improved.

Thirteenth Embodiment

Next, an expansion valve according to a thirteenth embodiment of the present invention will be described with reference to FIG. 13.

Figure 13:
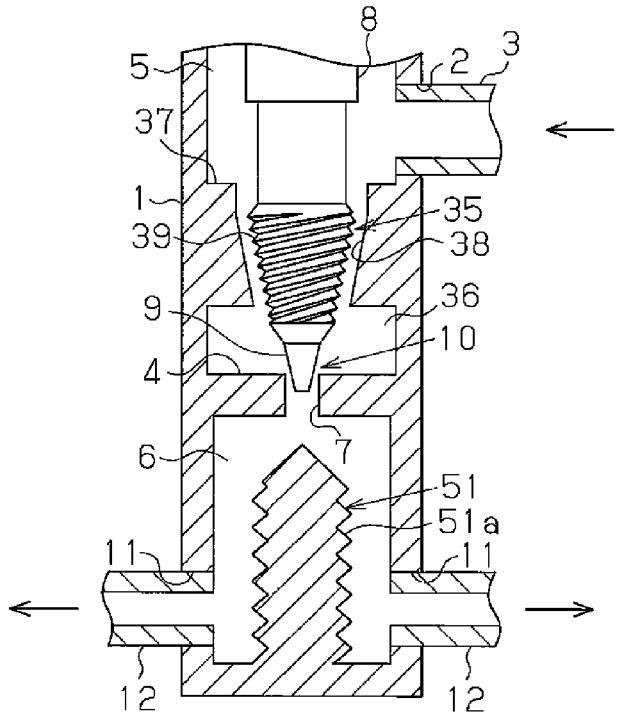
FIG. 13 is a partial longitudinal cross-sectional view illustrating an expansion valve according to a thirteenth embodiment of the present invention.

As shown in FIG. 13, in the expansion valve, an upstream side of a first throttle 10 is the same as that of the third embodiment, and a downstream side of the first throttle 10 is the same as that of the eighth embodiment. A second partition wall 37 is installed in a central portion of a valve chamber 5. An enlarged space portion 36 is formed between the second partition wall 37 and the first throttle 10. A tapered second valve hole 38 is formed at a center of the second partition wall 37, and a tapered second valve body 39 is formed in an intermediate portion of a valve rod 8. A helical passage is formed between an inner surface of a second valve hole 38 and an outer circumferential surface of the second valve body 39 as a second throttle 35.

Also, the expansion valve includes a refrigerant flow dividing chamber 6 shown in FIG. 8 in a lower portion a first partition wall 4. The expansion valve includes a turbulent flow generating member 51 which has a helical groove 51*a* formed on its surface. The turbulent flow generating member 51 extends upwardly from the bottom surface of the refrigerant flow dividing chamber 6 and is disposed on the same axis as a first valve hole 7. Flow dividing tube attachment holes 11 are formed in a lower portion of a valve body 1.

In the expansion valve according to the thirteenth embodiment of the present invention, when high-pressure liquid refrigerant of a single liquid phase flows to the expansion valve from an inlet port 2, the high-pressure liquid refrigerant is decompressed by the second throttle 35 and the first throttle 10 to be sprayed to the refrigerant flow dividing chamber 6. Therefore, refrigerant is uniformly divided in the refrigerant flow dividing chamber 6 with respect to each flow dividing tube 12 without being influenced by gravity.

Also, when refrigerant flows to the expansion valve with a slug flow or a plug flow, the refrigerant flow undergoes a throttling operation by the second throttle 35 and a passage enlarging operation at the enlarged space portion 36. As a result, bubbles in the refrigerant are subdivided, and so liquid refrigerant and gaseous refrigerant alternately flow through the first throttle 10, whereby a discontinuous refrigerant flow is mitigated. Also, since a passage is enlarged in the refrigerant flow dividing chamber 6 after refrigerant is sprayed to the refrigerant flow dividing chamber 6, the ejection energy of a refrigerant flow is dispersed. Also, the ejection energy of the refrigerant flow is reduced by a swirling operation by a helical groove 51*a*. As a result, the velocity fluctuation and the pressure fluctuation of the refrigerant flow are mitigated, whereby a discontinuous refrigerant flow is reduced.

Also, since bubbles in the refrigerant are further subdivided by undergoing a passage enlarging operation of the refrigerant flow dividing chamber 6 and a swirling operation by the helical groove 51*a*, the flow dividing characteristic of the refrigerant is further improved.

Fourteenth Embodiment

Next, an expansion valve according to a fourteenth embodiment of the present invention will be described with reference to FIG. 14.

Figure 14:
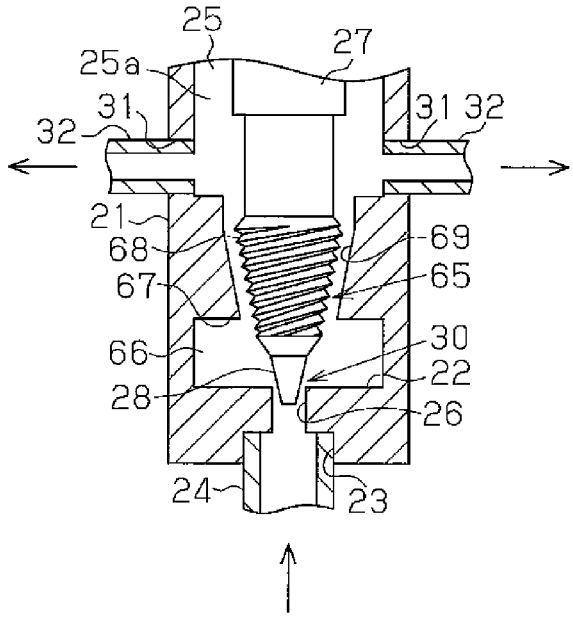
FIG. 14 is a partial longitudinal cross-sectional view illustrating an expansion valve according to a fourteenth embodiment of the present invention.

As shown in FIG. 14, the basic structure of the expansion valve is the same as that of the second embodiment in which the inside of the valve body 21 is used as an operation chamber 25. The expansion valve includes a third throttle 65 in an upper portion (on the upstream side of) a first throttle 30. The expansion valve includes an enlarged space portion 66 between the third throttle 65 and the first throttle 30. The expansion valve includes a third partition wall 67 on the downstream side of the first throttle 30, i.e., inside the operation chamber 25 and includes a flow dividing chamber portion 25*a* on the downstream side of the third partition wall 67. Flow dividing tube attachment holes 31 are formed in a sidewall of the flow dividing chamber portion 25*a*, and flow dividing tubes 32 are attached to the flow dividing tube attachment holes 31. The enlarged space portion 66 is formed below the third partition wall 67, i.e., between the third partition wall 67 and the first throttle 30.

A through hole which a third valve body 68 passes through is formed at a center of the partition wall 67. The through hole serves as a third valve hole 69 and is tapered. The third valve body 68 is formed in a middle portion of a valve rod 27. The third valve body 68 can move up and down inside the third valve hole 69. The third valve body 68 forms a third throttle 65 together with the third valve hole 69. A portion of the third valve body 68 corresponding to the third valve hole 69 has a tapered surface. A helical groove is formed on an outer circumferential surface of the third valve body 68. Accordingly, a helical passage is formed between the third valve body 68 and the third valve hole 69 as the third throttle 65. In the third throttle 65, as the valve rod 27 moves in a vertical direction, the cross-sectional area and the length of the helical passage vary. For example, when a refrigeration load is small, the valve rod 27 moves downward so that the cross-sectional area of the helical passage can decrease and the length of the helical passage can increase. As a result, the opening degree of the third throttle 65 decreases, so that flow resistance of a refrigerant flowing through the third throttle 65 increases. That is, the opening degree of the third throttle 65 can be varied by a vertical direction movement of the valve rod 27. The first throttle 30 includes a first valve hole 26 formed at a center of a lower wall 22 and a first valve body 28 which can advance and retreat with respect to the first valve hole 26 as with the second embodiment. The first valve body 28 is formed at a distal end of the valve rod 27. The opening degree of the first throttle 30 can be varied by a vertical direction movement of the valve rod 27.

In the expansion valve according to the fourteenth embodiment of the present invention, when single-phase liquid refrigerant flows to the expansion valve from an inlet port 23, liquid refrigerant is decompressed in the first throttle 30. A refrigerant decompressed in the first throttle 30 passes through the enlarged space portion 66, is further decompressed in the throttle 65 once more and is sprayed into the flow dividing chamber portion 25*a*. As a result, refrigerant is uniformly divided in the flow dividing chamber portion 25*a* with respect to each flow dividing tube 32 without being influenced by gravity.

Also, when refrigerant flows to the expansion valve with a slug flow or a plug flow, liquid refrigerant and gaseous refrigerant alternately flow through the first throttle 30, and so the velocity fluctuation and the pressure fluctuation are apt to occur in a refrigerant flow. However, in the present embodiment, since the enlarged space portion 66 is formed on the downstream side of the first throttle 30, the ejection energy of a refrigerant flow is dispersed in the enlarged space portion 66, so that the velocity fluctuation and the pressure fluctuation of a refrigerant flow are mitigated. Also, the ejection energy of a refrigerant flow is reduced due to the two-step throttle in which the first throttle 30 and the third throttle 65 are serially disposed, so that the velocity fluctuation and the pressure fluctuation of a refrigerant flow are mitigated. Also, the direction of a refrigerant flow passing through the third throttle 65 becomes uniform due to the helical passage. In addition, since the flow dividing chamber portion 25*a* functions as an enlarged space portion, the ejection energy of a refrigerant flow is dispersed in the flow dividing chamber portion 25*a*, and so the velocity fluctuation and the pressure fluctuation of a refrigerant flow are mitigated, whereby a discontinuous refrigerant flow noise is reduced.

Also, a flow of the refrigerant ejected from the first throttle 30 undergoes a passage enlarging operation in the enlarged space portion 66 and a throttling operation in the third throttle 65. As a result, bubbles in the refrigerant are subdivided, so that the flow dividing characteristic of the refrigerant of the flow dividing chamber portion 25*a* is further improved.

Fifteenth Embodiment

Next, an expansion valve according to a fifteenth embodiment of the present invention will be described with reference to FIG. 15.

Figure 15:
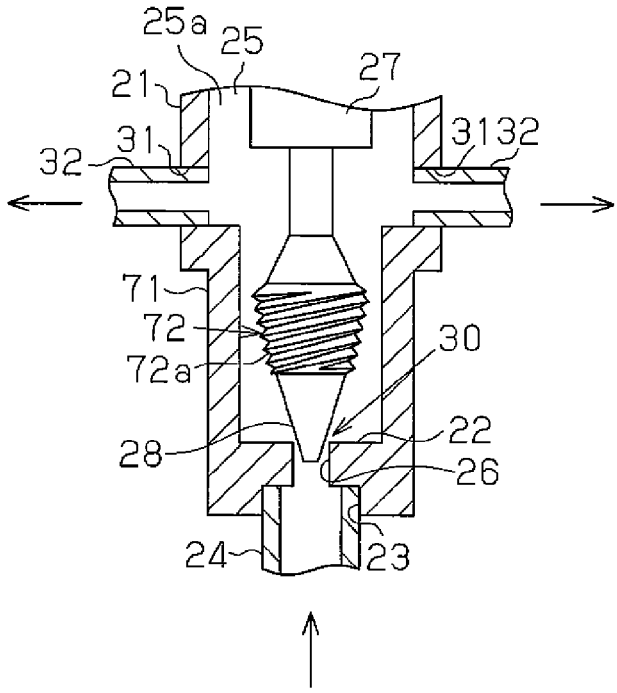
FIG. 15 is a partial longitudinal cross-sectional view illustrating an expansion valve according to a fifteenth embodiment of the present invention.

As shown in FIG. 15, the basic structure of the expansion valve is the same as that of the second embodiment in which the inside of the valve body 21 is used as an operation chamber 25. The expansion valve includes a turbulent flow generating member on the downstream side of a first throttle 30. The turbulent flow generating member includes a helical groove 72*a* that extends spirally about the axis of a first valve hole 26. The expansion valve includes an operation chamber 25 on the downstream side of the first throttle 30 as with the second embodiment of the present invention, and includes a small diameter portion 71 in a lower portion of the operation chamber 25. flow dividing tube attachment holes 31 are formed in a sidewall of a flow dividing chamber portion 25*a*, and flow dividing tubes 32 are connected to the flow dividing tube attachment holes 31.

A valve rod 27 has a turbulent flow generating member 72 at a portion corresponding to the small diameter portion 71, and the helical groove 72*a* are formed on an outer circumferential surface of the turbulent flow generating member 72. The turbulent flow generating member 72 is disposed in an upper portion (on the downstream side of) a first valve body 28. The turbulent flow generating member 72 is a middle portion of the valve rod 27 whose diameter is large as with the third valve body 68 of the eleventh embodiment. In the present embodiment, the gap between an outer circumferential surface of the turbulent flow generating member 72 and an inner surface of the small diameter portion 71 is not small enough to induce a throttling operation. Therefore, a refrigerant flowing around the turbulent flow generating member 72 undergoes a swirling operation by the helical groove 72*a* but does not undergo a throttling operation.

In the expansion valve according to the present embodiment, when single-phase liquid refrigerant flows from an inlet port 23, as with the second embodiment, refrigerant is sprayed to the operation chamber 25 and then passes through around the turbulent flow generating member 72, whereby refrigerant is uniformly divided with respect to each flow dividing tube 32.

Also, when refrigerant flows to the expansion valve from the inlet port 23 with a slug flow or a plug flow, liquid refrigerant and gaseous refrigerant (bubbles) alternately flow through the first throttle 30, and so the velocity fluctuation and the pressure fluctuation are apt to occur in a refrigerant flow. However, in the present embodiment, since a passage in the operation chamber 25 is enlarged, the ejection energy of a refrigerant flow is dispersed. Also, since a swirling operation is performed by the helical groove 72*a*, the ejection energy of a refrigerant flow is reduced. As a result, the velocity fluctuation and the pressure fluctuation of a refrigerant flow are mitigated, whereby a discontinuous refrigerant flow noise is reduced. Also, since a refrigerant ejected from the first throttle 30 is swirled by the helical groove 72*a*, bubbles in a refrigerant are further subdivided. Therefore, the flow dividing characteristic of the refrigerant of the flow dividing chamber portion 25*a* is further improved.

Sixteenth Embodiment

Next, an expansion valve according to a sixteenth embodiment of the present invention will be described with reference to FIGS. 16 and 17.

Figure 16:
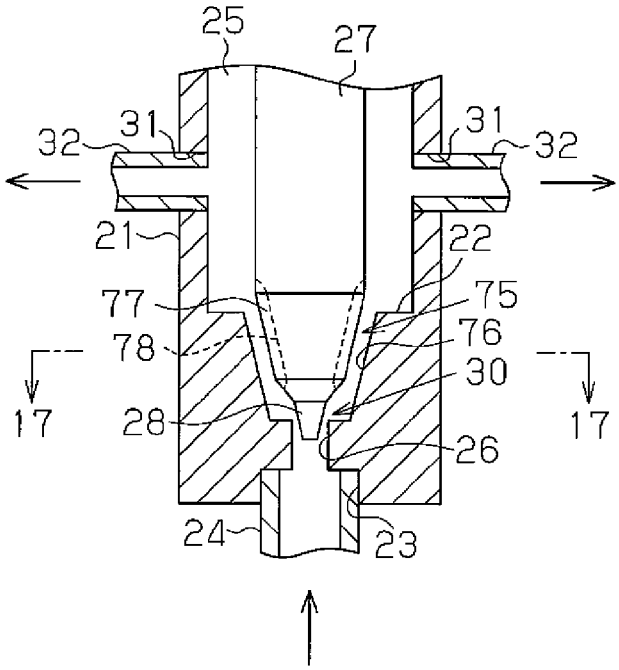
FIG. 16 is a partial longitudinal cross-sectional view illustrating an expansion valve according to a sixteenth embodiment of the present invention.
Figure 17:
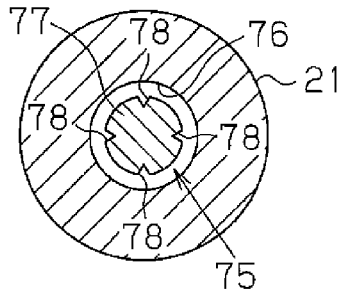
FIG. 17 is a cross-sectional view taken along line 17-17 of FIG. 16.

As shown in FIGS. 16 and 17, the basic structure of the expansion valve is the same as that of the second embodiment in which the inside of the valve body 21 is used as an operation chamber 25. The expansion valve includes a third throttle 75 in an upper portion (on the downstream side of) a first throttle 30. The third throttle 75 is formed by a plurality of passages. In the expansion valve, a lower wall 22 of the valve body 21 is thick. A tapered third valve hole 76 whose diameter becomes smaller downwardly, a first valve hole 26 whose diameter is smaller than the third valve hole 76, and an inlet port 23 whose diameter is larger than the first valve hole 26 are formed in a center of the lower wall 22. Therefore, the thickness of the lower wall 22 in a vertical direction is larger than that of the present embodiment.

A portion of a valve rod 27 corresponding to the third valve hole 76 includes a third valve body 77. An outer circumferential surface of the third valve body 77 has a tapered shape whose diameter becomes smaller downwardly. A plurality of grooves 78 are provided on the outer circumferential surface of the third valve body 77 as shown in FIG. 17. Each of the grooves 78 has a constant depth and have a triangular cross section. Each of the grooves 78 is formed on the outer circumferential surface of the third valve body 77 at regular intervals. The third valve body 77 can move in a vertical direction while maintaining a predetermined gap between itself and an inner surface of the third valve hole 76. The third valve body 77 and the third valve hole 76 form the third throttle 75. In the third throttle 75 according to the present embodiment, the valve body 21 and the third valve body 77 are not completely separated from each other. However, a plurality of throttling passages which extend in a vertical direction are formed in the third throttle 75 by the grooves 78.

In the present embodiment, when single-phase liquid refrigerant flows to the expansion valve from an inlet port 23, the liquid refrigerant is decompressed in the first throttle 30. A refrigerant decompressed in the first throttle 30 is further decompressed in the third throttle 75 and is sprayed into the operation chamber 25 from the third throttle 75. As a result, refrigerant is uniformly divided in the operation chamber 25 with respect to each flow dividing tube 32 without being influenced by gravity.

Also, when refrigerant flows to the expansion valve from the inlet port 23 with a slug flow or a plug flow, liquid refrigerant and gaseous refrigerant (bubbles) alternately flow through the first throttle 30, and so the velocity fluctuation and the pressure fluctuation are apt to occur in a refrigerant flow. However, in the present embodiment, the ejection energy of a refrigerant flow is reduced due to the two-step throttle in which the first throttle 30 and the third throttle 75 are serially disposed. Also, since the third throttle 75 includes a plurality of throttling passages, the ejection energy of a refrigerant flow is dispersed. As a result, the velocity fluctuation and the pressure fluctuation of a refrigerant flow are further mitigated, whereby a discontinuous refrigerant flow noise is reduced.

In addition, a refrigerant flow undergoes a throttling operation by the third throttle 75, and dispersing and gathering operations at an inlet and an outlet of each throttling passage. Therefore, since bubbles in a flow of the refrigerant ejected from the first throttle 30 are subdivided, the flow dividing characteristic of the refrigerant of the operation chamber 25 is further improved.

Seventeenth Embodiment

Next, an expansion valve according to a seventeenth embodiment of the present invention will be described with reference to FIG. 18.

Figure 18:
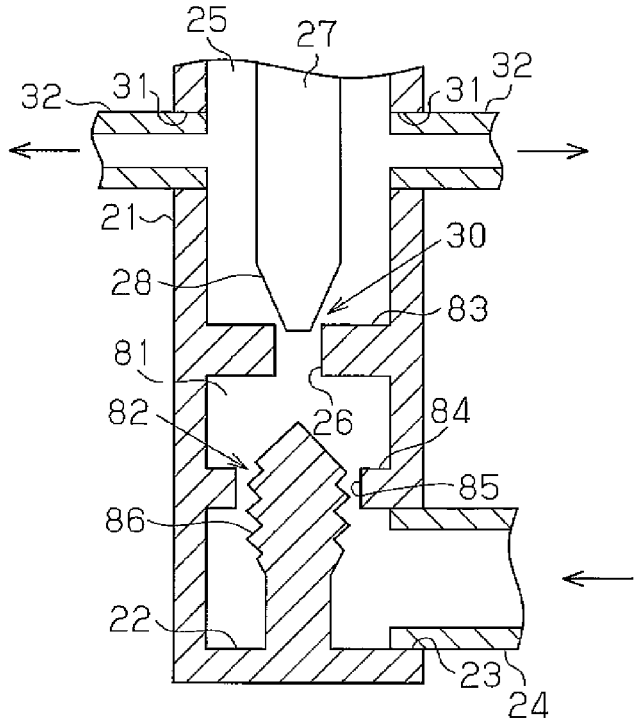
FIG. 18 is a partial longitudinal cross-sectional view illustrating an expansion valve according to a seventeenth embodiment of the present invention.

As shown in FIG. 18, the basic structure of the expansion valve is the same as that of the second embodiment in which the inside of the valve body 21 is used as the operation chamber 25. The expansion valve includes an enlarged space portion 81 and a second throttle 82 as bubble subdividing means on the upstream side of a first throttle 30. The expansion valve according to the present embodiment includes a first partition wall 83 which partitions a space inside a valve body 21 into an upper portion and a lower portion. A first valve hole 26 is formed at a center of the first partition wall 83. The enlarged space portion 81 and the second throttle 82 are installed in the lower portion of the first partition wall 83, i.e., on the upstream side of the first throttle 30 as the bubble subdividing means. A straight second valve hole 85 which extends along the axis of a valve rod 27 is installed at a center of a lower wall 84 of the enlarged space portion 81. The second throttle 82 is formed by the second valve hole 85 and the second valve body 86. The second valve body 86 forms an upper portion of a turbulent flow generating member which extends upwardly from the lower wall 22 of the valve body 21. The second valve body 86 includes a substantially cylindrical body and is disposed with a predetermined gap between itself and the valve body 21 inside the second valve hole 85. A helical groove is formed on an outer circumferential surface of the second valve body 86. A helical passage is formed between the second valve body 86 and the second valve hole 85 as a second throttle 82. The second throttle 82 is a throttle with a constant opening degree.

In the expansion valve of the present embodiment, when single-phase liquid refrigerant flows to the expansion valve from an inlet port 23, the liquid refrigerant is decompressed by the second throttle 82 and the first throttle 30. A refrigerant decompressed in the first throttle 30 is sprayed into the operation chamber 25 from the first throttle 30. As a result, refrigerant is uniformly divided in the operation chamber 25 with respect to each flow dividing tube 32 without being influenced by gravity.

Also, when refrigerant flows to the expansion valve from the inlet port 23 with a slug flow or a plug flow, bubbles in a refrigerant flow are subdivided while passing through the second throttle 82. Also, due to the enlargement of the passage in the enlarged space portion 81, the ejection energy of a refrigerant flow after passing through the second throttle 82 is dispersed. Also, since bubbles of a refrigerant flow flowing into the first throttle 30 are subdivided, a refrigerant flow becomes continuous, so that a discontinuous refrigerant flow noise is reduced. Particularly, since the second throttle 82 has a helical passage, a throttling passage can be made longer. As a result, the direction of a refrigerant flow becomes uniform, and so the bubble subdivision effect is improved.

Also, when a refrigerant flow becomes continuous, the velocity fluctuation and the pressure fluctuation of a refrigerant flow passing through the first throttle 30 are mitigated. Also, since two-step throttling is formed by the second and first throttles 82 and 30, the ejection energy of a refrigerant flow is further reduced by each throttle, so that the velocity fluctuation and the pressure fluctuation of a refrigerant flow are further mitigated. Also, due to the passage enlargement in the enlarged space portion 81 the ejection energy of a refrigerant flow which has passed through the second throttle 82 is dispersed. As a result, the velocity fluctuation and the pressure fluctuation of a refrigerant flow are mitigated, whereby a discontinuous refrigerant flow noise is further reduced.

Eighteenth Embodiment

Next, an expansion valve according to an eighteenth embodiment of the present invention will be described with reference to FIG. 19.

Figure 19:
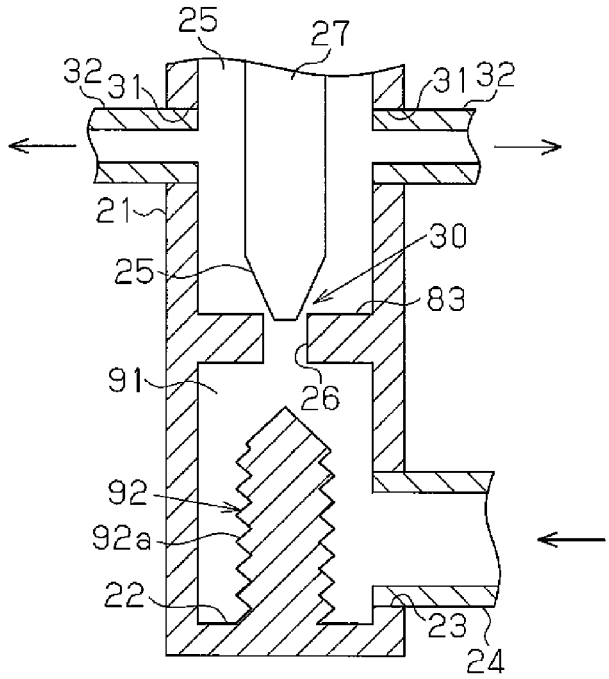
FIG. 19 is a partial longitudinal cross-sectional view illustrating an expansion valve according to an eighteenth embodiment of the present invention.

As shown in FIG. 19, the basic structure of the expansion valve is the same as that of the second embodiment in which the inside of the valve body 21 is used as an operation chamber 25. The expansion valve includes a turbulence generating portion as bubble subdividing means on the upstream side of a first throttle 30. The expansion valve of the present embodiment is the same as that of the seventeenth embodiment except that the bubble subdividing means is different. The expansion valve includes a first partition wall 83 which partitions a space inside a valve body 21 into an upper portion and a lower portion. A space portion 91 is formed in the lower portion of the first partition wall 83 (on the upstream side of a first throttle 30). A turbulence generating portion for swirling a refrigerant flow flowing into the first throttle 30 is formed in the space portion 91. The turbulence generating portion includes a turbulent flow generating member 92 which extends upwardly from a lower wall 22 of the valve body 21. A helical groove 92*a* is formed on a surface of the turbulent flow generating member 92. An upper end portion of the turbulent flow generating member 92 is conical.

In the expansion valve according to the present embodiment, when single-phase liquid refrigerant flows to the expansion valve from an inlet port 23, a refrigerant passes around the turbulent flow generating member 92, is decompressed in the first throttle 30, and is sprayed into the operation chamber 25 from the first throttle 30. As a result, refrigerant is uniformly divided in the operation chamber 25 with respect to each flow dividing tube 32 without being influenced by gravity.

Also, when refrigerant flows to the expansion valve from the inlet port 23 with a slug flow or a plug flow, a refrigerant flow is swirled while passing around the turbulent flow generating member 92. As a result, a refrigerant flow is shaken up, and so bubbles in a refrigerant flow are subdivided. Accordingly, a refrigerant flow flowing through the first throttle 30 becomes continuous, so that the velocity fluctuation and the pressure fluctuation of a refrigerant flow are mitigated, whereby a discontinuous refrigerant flow noise is reduced.

Nineteenth Embodiment

Next, an expansion valve according to a nineteenth embodiment of the present invention will be described with reference to FIG. 20.

Figure 20:
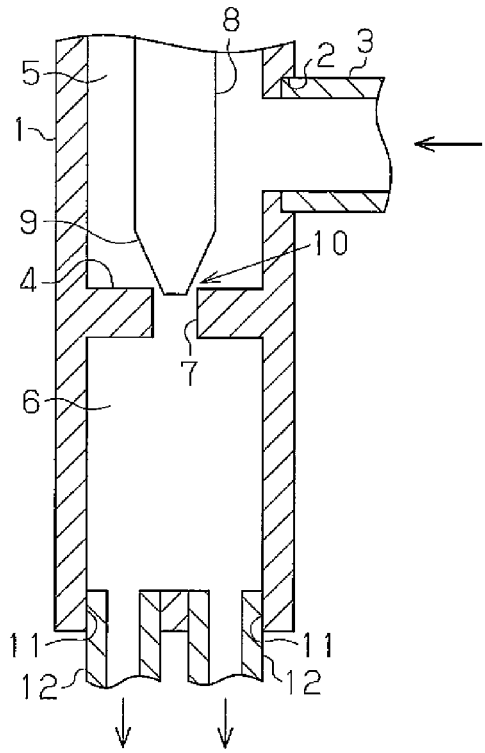
FIG. 20 is a partial longitudinal cross-sectional view illustrating an expansion valve according to a nineteenth embodiment of the present invention.

As shown in FIG. 20, the expansion valve is one in which the locations of the flow dividing tube attachment holes 11 of the refrigerant flow dividing chamber 6 according to the first embodiment of the present invention are changed. Four flow dividing tube attachment holes 11 are installed on a wall body of a valve body 1 opposite to a first throttle 10. The flow dividing tube attachment holes 11 are disposed on a circumference centering on the axis of the first throttle 10 at regular intervals. Each of the flow dividing tubes 12 is attached to each of the flow dividing tube attachment holes 11 so that it is attached perpendicularly to a wall of the valve body 21.

The expansion valve according to the present embodiment has the same effects as the first embodiment with respect to the flow dividing characteristic of the refrigerant. That is, since refrigerant is sprayed to a refrigerant flow dividing chamber 6 from the first throttle 10, it is uniformly divided with respect to each of the flow dividing tubes 12 without being influenced by gravity. Also, the first throttle 10 also serves as a throttle in a refrigerant flow divider. Therefore, an appropriate throttling degree is provided according to an increment or decrement of a refrigeration load, so that the flow dividing characteristic of the refrigerant is further improved.

The expansion valve according to the present embodiment has the same effects as the first embodiment with respect to a refrigerant flow noise. That is, when refrigerant flows to the expansion valve from the inlet port 2 with a slug flow or a plug flow, since the ejection energy of a refrigerant flow is dispersed in the refrigerant flow dividing chamber 6, the velocity fluctuation and the pressure fluctuation of a refrigerant flow are mitigated, whereby a discontinuous refrigerant flow noise is reduced. Also, even though refrigerant flows in a reverse direction, that is, even though a gas-liquid two-phase flow flows to the expansion valve from each of the flow dividing tubes 12 when a heating operation starts, a refrigerant flow noise is reduced.

Also, in the expansion valve according to the present embodiment, since the refrigerant flow dividing chamber 6 is designed while maintaining the structure of a conventional valve chamber as with the first embodiment, a restriction to design of the refrigerant flow dividing chamber 6 is small. Also, in the nineteenth embodiment of the present invention, a plurality of flow dividing tubes 12 can be respectively attached to each of the flow dividing tube attachment holes 11 in a state that they are tied up into a thin and long bundle.

Twentieth Embodiment

Next, an expansion valve according to a twentieth embodiment of the present invention will be described with reference to FIG. 21.

Figure 21:
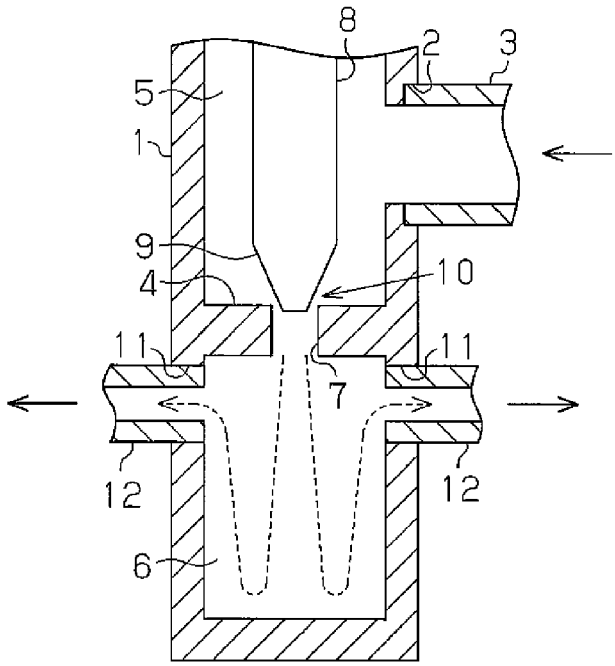
FIG. 21 is a partial longitudinal cross-sectional view illustrating an expansion valve according to a twentieth embodiment of the present invention.

As shown in FIG. 21, the expansion valve is one in which the locations of the flow dividing tube attachment holes 11 of the refrigerant flow dividing chamber 6 according to the nineteenth embodiment of the present invention are changed. In the present embodiment, flow dividing tube attachment holes 11 are formed on a sidewall of a valve body 1 which constitutes a refrigerant flow dividing chamber 6. The flow dividing tube attachment holes 11 are provided near a first throttle 10, and flow dividing tubes 12 are attached to the flow dividing tube attachment holes 11. The refrigerant flow dividing chamber 6 is opened through the flow dividing tubes 12. In this case, a flow of the refrigerant ejected from the first throttle 10 collides with a wall opposite to the first throttle 10 and is then transmitted to the outside of the expansion valve through the flow dividing tubes 12 as indicated by broken lines in FIG. 21.

In the expansion valve according to the twentieth embodiment of the present invention, a flow of the refrigerant ejected from the first throttle 10 does not flow directly into the flow dividing tubes 12 but reverses before flowing into the flow dividing tubes 12. As a result, the reversed refrigerant flow is less susceptible to fluctuation of a gas-liquid two-phase flow flowing into the expansion valve, and so the velocity of a refrigerant flow at inlets of the flow dividing tubes 12 can be reduced. Due to such operations, the flow dividing characteristic of the refrigerant of the refrigerant flow dividing chamber 6 is improved.

Twenty-First Embodiment

Next, an expansion valve according to a twenty-first embodiment of the present invention will be described with reference to FIG. 22.

Figure 22:
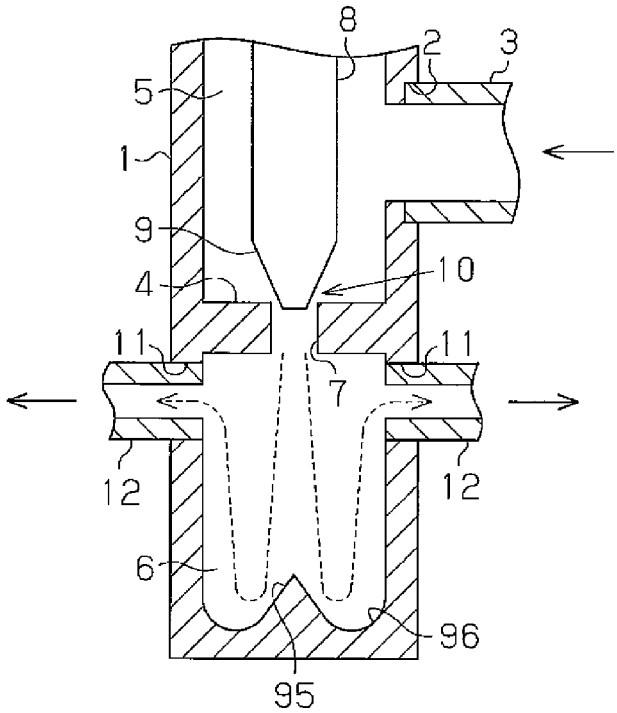
FIG. 22 is a partial longitudinal cross-sectional view illustrating an expansion valve according to a twenty-first embodiment of the present invention.

As shown in FIG. 22, the expansion valve is one in which the shape of a wall opposite to the first throttle 10 in the refrigerant flow dividing chamber 6 according to the twentieth embodiment of the present invention is changed. In the present embodiment, a valve body 1 includes a guide portion on a wall opposite to the first throttle 10. The guide portion serves to widen a flow of the refrigerant ejected from the first throttle 10 in a lateral direction so that its direction smoothly reverses. The guide portion includes a conical protruding portion 95 and a circular arc surface 96 installed near the protruding portion 95. The protruding portion 95 is installed on a wall opposite to the first throttle 10, and the circular arc surface 96 is installed in an area of from the protruding portion 95 to a corner portion of the refrigerant flow dividing chamber 6.

According to the present embodiment, it is possible to prevent a turbulent flow which occurs when the direction of a flow of the refrigerant ejected from the first throttle 10 is changed. Therefore, when a refrigerant flow flows to the expansion valve from an inlet port 2 as a gas-liquid two-phase flow, since the direction of a refrigerant flow is smoothly changed by the guide portion, the ejection energy of a refrigerant flow is reduced, so that bubbles in a refrigerant flow are subdivided. Accordingly, a refrigerant flow noise is reduced.

Twenty-Second Embodiment

Next, an expansion valve according to a twenty-second embodiment of the present invention will be described with reference to FIG. 23.

Figure 23:
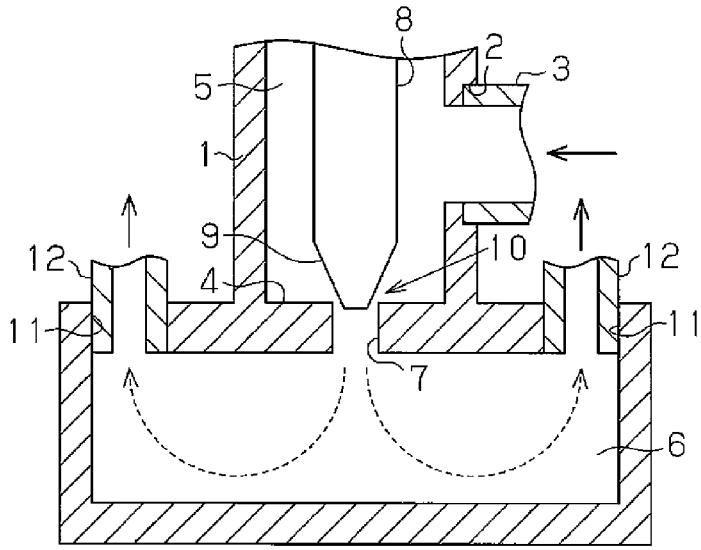
FIG. 23 is a partial longitudinal cross-sectional view illustrating an expansion valve according to a twenty-second embodiment of the present invention.

As shown in FIG. 23, the expansion valve is one in which the shape of the refrigerant flow dividing chamber 6 and attachment locations of the flow dividing tube attachment holes 11 according to the second embodiment are changed. In the present embodiment, a refrigerant flow dividing chamber 6 is formed such that, centering on the axis of a first throttle 10, the dimension in a radial direction (lateral direction) is greater than the dimension of the axial direction (vertical direction) of the first throttle 10. That is, the refrigerant flow dividing chamber 6 is formed to be widened in a radial direction, centering on the axis of the expansion valve. Flow dividing tube attachment holes 11 are provided in an outer circumference of a valve body 1 near the first throttle 10, and flow dividing tubes 12 are attached to the flow dividing tube attachment holes 11. The refrigerant flow dividing chamber 6 is opened through the flow dividing tubes 12.

According to the present embodiment, a flow of the refrigerant ejected from the first throttle 10 hardly flows directly into the flow dividing tubes 12. Therefore, the same effects as the twentieth embodiment are obtained, whereby the flow dividing characteristic of the refrigerant in the dividing chamber 6 is improved.

Twenty-Third Embodiment

Next, an expansion valve according to a twenty-third embodiment of the present invention will be described with reference to FIG. 24.

Figure 24:
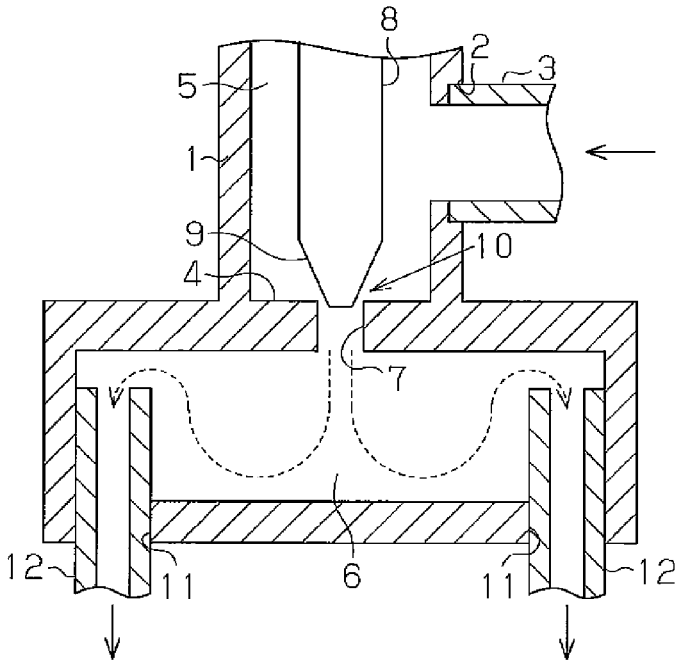
FIG. 24 is a partial longitudinal cross-sectional view illustrating an expansion valve according to a twenty-third embodiment of the present invention.

As shown in FIG. 24, the expansion valve is one in which the attachment locations of the flow dividing tube attachment holes 11 and the flow dividing tubes 12 according to the twenty-third embodiment are changed. In the present embodiment, flow dividing tube attachment holes 11 are provided on a wall body of a valve body 1 opposite to a first throttle 10, and flow dividing tubes 12 are attached to the flow dividing tube attachment holes 11. The flow dividing tubes 12 are inserted into, passed through, and fixed into the flow dividing tube attachment holes 11 and at the same time extend to a location in a refrigerant flow dividing chamber 6 adjacent to a wall near the first throttle 10.

According to the present embodiment, as indicated by broken lines in FIG. 24, a refrigerant flow is ejected from the first throttle 10, reverses upwardly and flows to inlets of the flow dividing tubes 12. Therefore, the same effects as the twenty-second embodiment are obtained. Also, a plurality of flow dividing tubes 12 may be attached along the axis of the expansion valve.

Twenty-Fourth Embodiment

Next, an expansion valve according to a twenty-fourth embodiment of the present invention will be described with reference to FIG. 25.

Figure 25:
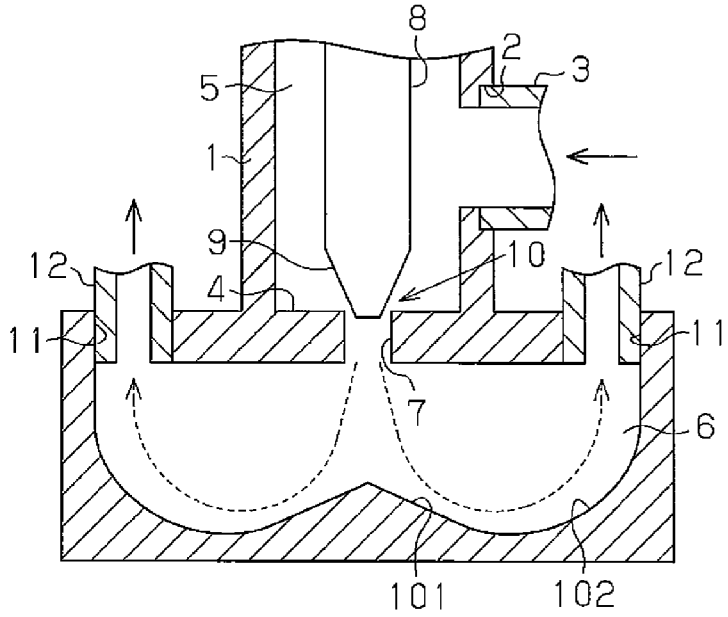
FIG. 25 is a partial longitudinal cross-sectional view illustrating an expansion valve according to a twenty-fourth embodiment of the present invention.

As shown in FIG. 25, the expansion valve is one in which the shape of a wall opposite to the first throttle 10 in the refrigerant flow dividing chamber 6 according to the twenty-second embodiment is changed. In the present embodiment, a guide portion is formed on a wall opposite to a first throttle 10. The guide portion serves to widen a flow of the refrigerant ejected from the first throttle 10 in a lateral direction so that the refrigerant flow can reverse more smoothly. The guide portion includes a conical protruding portion 101 and a curved surface portion 102 installed near the protruding portion 101. The protruding portion 101 is installed on a wall opposite to the first throttle 10, and the curved surface portion 102 is formed in an area from the protruding portion 101 to a corner portion of the refrigerant flow dividing chamber 6.

According to the present embodiment, it is possible to prevent a turbulent flow which occurs when the direction of a flow of the refrigerant ejected from the first throttle 10 is changed. Therefore, when a refrigerant flow flows in from a inlet port 2 as a gas-liquid two-phase flow, since the direction of a refrigerant flow is smoothly changed by the guide portion, the ejection energy of a refrigerant flow is reduced, so that bubbles in a refrigerant flow are subdivided. Accordingly, a refrigerant flow noise is reduced.

Twenty-Fifth Embodiment

Next, an expansion valve according to a twenty-fifth embodiment of the present invention will be described with reference to FIG. 26.

Figure 26:
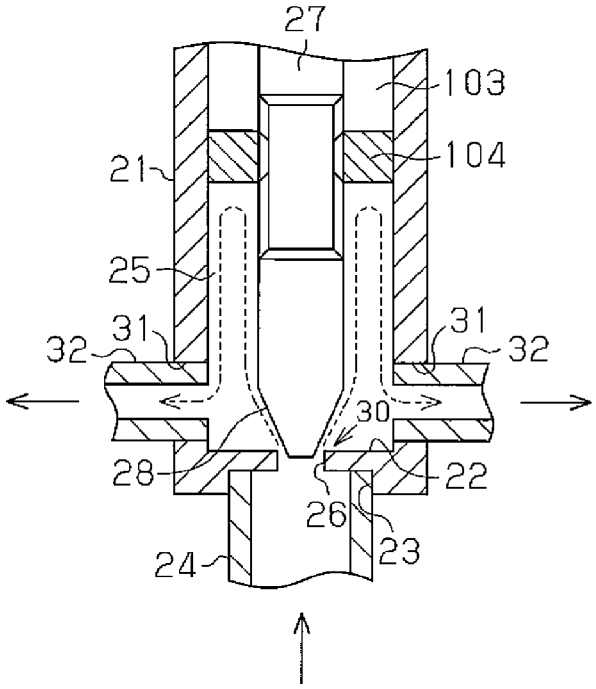
FIG. 26 is a partial longitudinal cross-sectional view illustrating an expansion valve according to a twenty-fifth embodiment of the present invention.

As shown in FIG. 26, the expansion valve is one in which the second embodiment is modified such that the direction of a flow of the refrigerant flowing to the inside of the operation chamber 25 reverses. In the present embodiment, flow dividing tube attachment holes 31 are provided in a sidewall of a valve body 21 which constitutes an operation chamber 25. Flow dividing tube attachment holes 31 are provided near a first throttle 30, i.e., in a lower portion of the operation chamber 25, and flow dividing tubes 32 are attached to the flow dividing tube attachment holes 31. The operation chamber 25 is opened through the flow dividing tubes 12. As a result, as indicated by broken lines, a flow of the refrigerant ejected from the first throttle 30 is ejected to between a valve rod 27 and an outer circumferential wall of a valve body 21, collides with a partition wall 104 which partitions a driving portion 103 and the operation chamber 25 to reverses, and then flows into the flow dividing tube 32.

According to the present embodiment, since the valve chamber has a double purpose as the refrigerant flow dividing chamber as with the second embodiment of the present invention, the expansion valve can be made smaller. Also, since the flow dividing tube attachment holes 31 are disposed near the first throttle 30, a flow of the refrigerant ejected from the first throttle 30 does not flow directly into the flow dividing tube 32 but reverses before flowing into the flow dividing tube 32. Accordingly, the flow dividing characteristic of the refrigerant is improved, whereby a refrigerant flow noise is further reduced.

Twenty-Sixth Embodiment

Next, an expansion valve according to a twenty-sixth embodiment of the present invention will be described with reference to FIG. 27.

Figure 27:
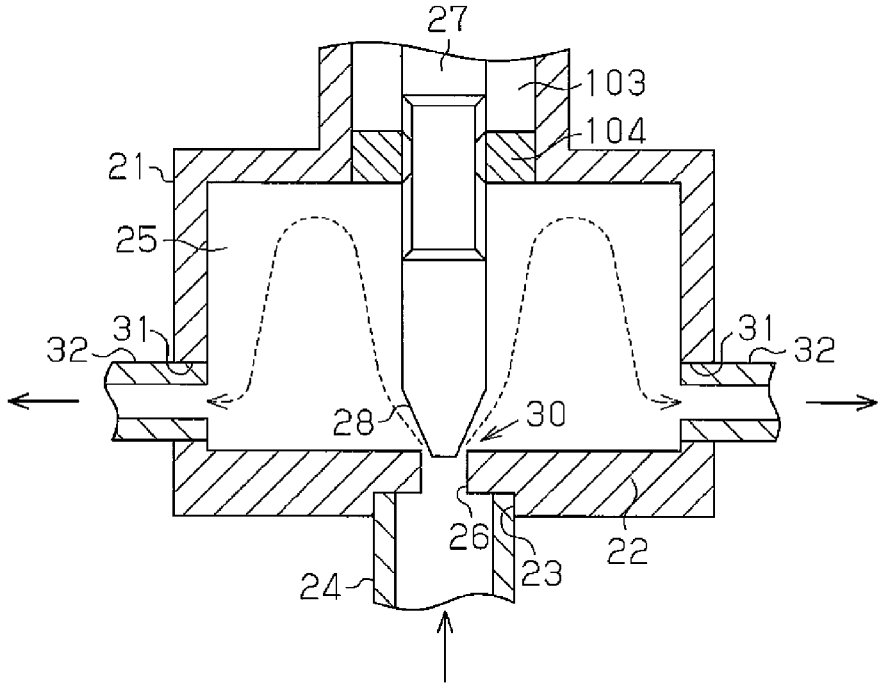
FIG. 27 is a partial longitudinal cross-sectional view illustrating an expansion valve according to a twenty-sixth embodiment of the present invention.

As shown in FIG. 27, the expansion valve is one in which the shape of the operation chamber 25 according to the twenty-fifth embodiment is changed. In other words, in the present embodiment, an operation chamber 25 is formed such that, centering on the axis of a first throttle 30, the dimension in a radial direction (lateral direction) is greater than the dimension of the axial direction (vertical direction) of the first throttle 30. That is, the operation chamber 25 is formed to be widened in a radial direction, centering on the axis of the expansion valve.

According to the present embodiment, a flow of the refrigerant ejected from the first throttle 30 hardly flows directly to flow dividing tubes 32. Therefore, the same effects as the twenty-fifth embodiment are obtained, whereby the flow dividing characteristic of the refrigerant is in the operation chamber 25 improved.

Twenty-Seventh Embodiment

Next, an expansion valve according to a twenty-seventh embodiment of the present invention will be described with reference to FIG. 28.

Figure 28:
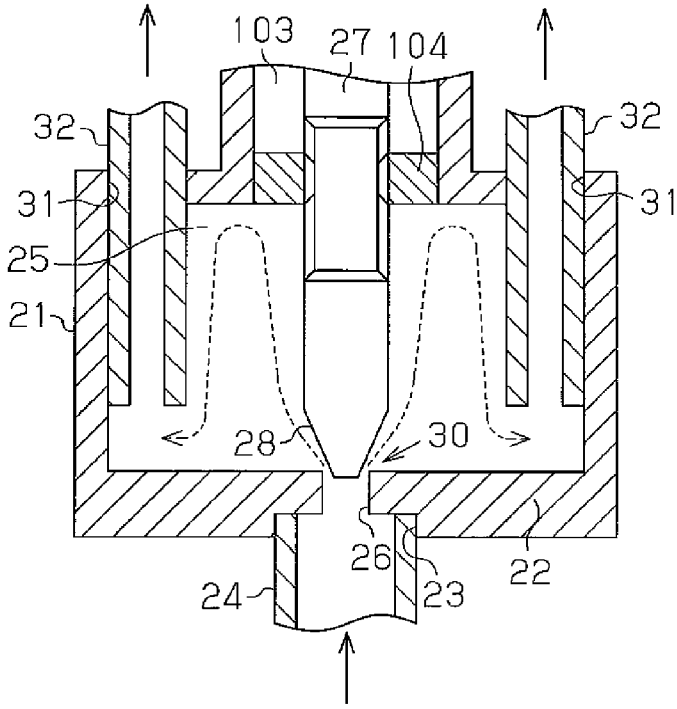
FIG. 28 is a partial longitudinal cross-sectional view illustrating an expansion valve according to a twenty-seventh embodiment of the present invention.

As shown in FIG. 28, the expansion valve is one in which the attachment locations of the flow dividing tube attachment holes 31 and the flow dividing tubes 32 according to the twenty-sixth embodiment are changed. In the present embodiment, flow dividing tube attachment holes 31 are provided on a wall body opposite to a first throttle 30, i.e., in an upper wall of a valve body 21 which constitutes an operation chamber 25. Flow dividing tubes 32 are inserted into, passed through, and fixed into the flow dividing tube attachment holes 31. The operation chamber 25 is opened through the flow dividing tube 32 at a location adjacent to the first throttle 30.

According to the present embodiment, as indicated by broken lines, a flow of the refrigerant ejected from the first throttle 30 reverses upwardly and then flows to an inlet of the flow dividing tube 32. Therefore, the same effects as the twenty-sixth embodiment are obtained. Also, a plurality of flow dividing tubes 32 may be attached along the axis of the expansion valve.

Twenty-Eighth Embodiment

Next, an expansion valve according to a twenty-eighth embodiment of the present invention will be described with reference to FIG. 29.

Figure 29:
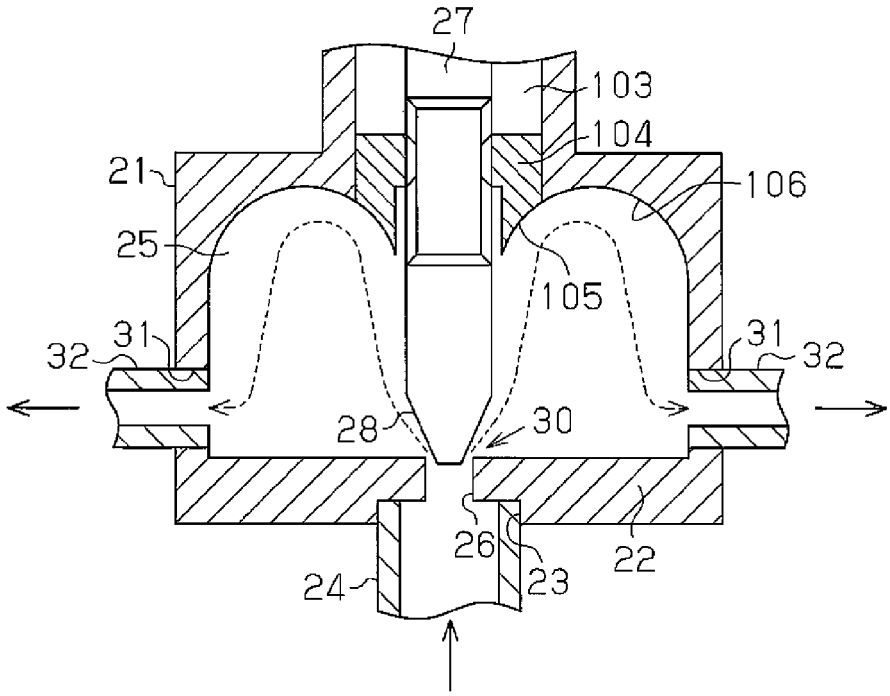
FIG. 29 is a partial longitudinal cross-sectional view illustrating an expansion valve according to a twenty-eighth embodiment of the present invention.

As shown in FIG. 29, the expansion valve is one in which the shape of a wall body opposite to the first throttle 30 in the operation chamber 25 according to the twenty-sixth embodiment is changed. In the present embodiment, a wall opposite to a first throttle 30 includes a partition wall 104 which partitions a driving portion 103 and an operation chamber 25 at its center. An upper wall of a valve body 21 which constitutes an operation chamber 25 is installed in a peripheral portion of the partition wall 104. In the twenty-eighth embodiment of the present invention, due to such a wall structure, a guide portion is formed to widen a flow of the refrigerant ejected from the first throttle 30 in a lateral direction so that the direction of a refrigerant flow can reverse more smoothly. In detail, the guide portion includes a conical protruding portion 105 and a curved surface portion 106 installed near the protruding portion 105. The protruding portion 105 is installed in an inner edge of the partition wall 104, and the curved surface portion 106 is formed in an area of from the protruding portion 105 to an inner surface of a sidewall of the valve body 21.

According to the present embodiment, it is possible to prevent a turbulent flow which occurs when the direction of a flow of the refrigerant ejected from the first throttle 30 is changed. Therefore, when a refrigerant flow flows in from a liquid tube 24 as a gas-liquid two-phase flow, the direction of a refrigerant flow is smoothly changed by the guide portion. Therefore, the ejection energy of a refrigerant flow is reduced, and so bubbles in a refrigerant flow are subdivided, whereby a refrigerant flow noise is reduced.

Twenty-Ninth Embodiment

Next, an expansion valve according to a twenty-ninth embodiment of the present invention will be described with reference to FIG. 30.

Figure 30:
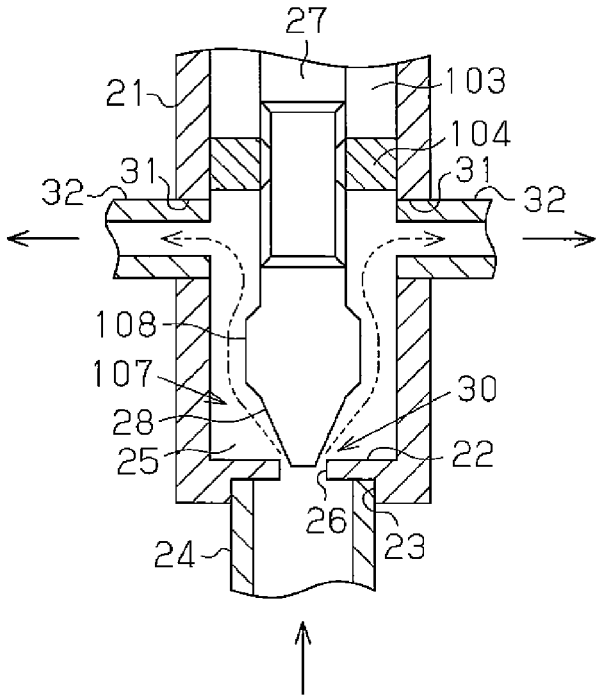
FIG. 30 is a partial longitudinal cross-sectional view illustrating an expansion valve according to a twenty-ninth embodiment of the present invention.

As shown in FIG. 30, the expansion valve is one that includes a meandering flow generating portion 107 for allowing a refrigerant to flow in a meandering way between the first throttle 30 and the flow dividing tube attachment holes 31 in the second embodiment. The meandering flow generating portion 107 is formed in a large diameter portion 108 of a valve rod 27. As a result, a refrigerant passage is formed in a meandering way between a first throttle 30 and flow dividing tube attachment holes 31.

According to the present embodiment, since a valve chamber has a double purpose as a refrigerant flow dividing chamber as with the second embodiment, the expansion valve can be made smaller. Also, by causing a flow of the refrigerant ejected from the first throttle 30 to flow in a meandering way by the meandering flow generating portion 107, refrigerant is prevented from flowing directly to flow dividing tubes 32. As a result, the flow dividing characteristic of the refrigerant are improved, so that a refrigerant flow noise is reduced.

Thirtieth Embodiment

Next, an expansion valve according to a thirtieth embodiment of the present invention will be described with reference to FIG. 31.

Figure 31:
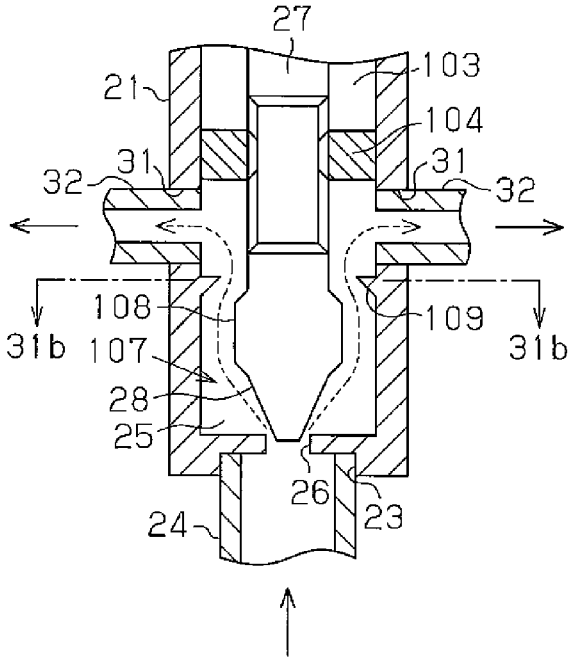
FIG. 31(*a*) is a partial longitudinal cross-sectional view illustrating an expansion valve according to a thirtieth embodiment of the present invention.
Figure 31:
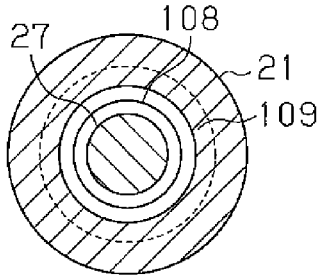
Figure 31:
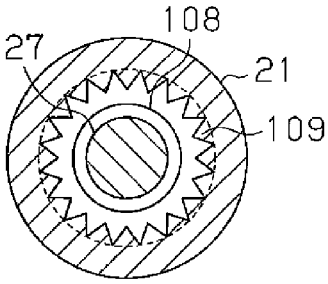
Figure 31:
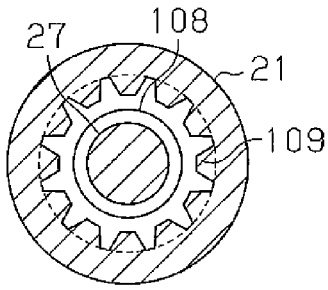

As shown in FIG. 31, the expansion valve is one in which the meandering flow generating portion 107 of the twenty-ninth embodiment is improved. In the present embodiment, in addition to the fact that a meandering flow generating portion 107 is formed in a large diameter portion 108 of a valve rod 27, a shoulder 109 is formed along an inner circumferential edge of a valve body 21 which constitutes an operation chamber 25. The shoulder 109 is positioned near flow dividing tube attachment holes 31. The inner circumferential edge of the shoulder typically has a smooth shape, but in order to produce a turbulent flow in a refrigerant flow, it may have a saw tooth shape as shown in FIG. 31(*c*) or a shape with a step-difference (uneven) as shown in FIG. 31(*d*).

A refrigerant flow which passes around a large diameter portion 108 and flows into the flow dividing tube attachment holes 31 can be deflected inwardly by the shoulder. By causing a refrigerant flow to meander as described above, the energy of the refrigerant flow can be consumed. Therefore, the refrigerant flow dividing effect of a refrigerant flow is improved, and so a refrigerant flow noise is further reduced. Also, when the shoulder shown in FIG. 31(*c*) or 31(*d*) is used, a refrigerant flow is further shaken up, so that bubbles in a refrigerant become smaller. As a result, an excellent refrigerant flow dividing effect and an excellent refrigerant flow noise reduction effect are further achieved.

Thirty-First Embodiment

Next, an expansion valve according to a thirty-first embodiment of the present invention will be described with reference to FIG. 32.

Figure 32A:
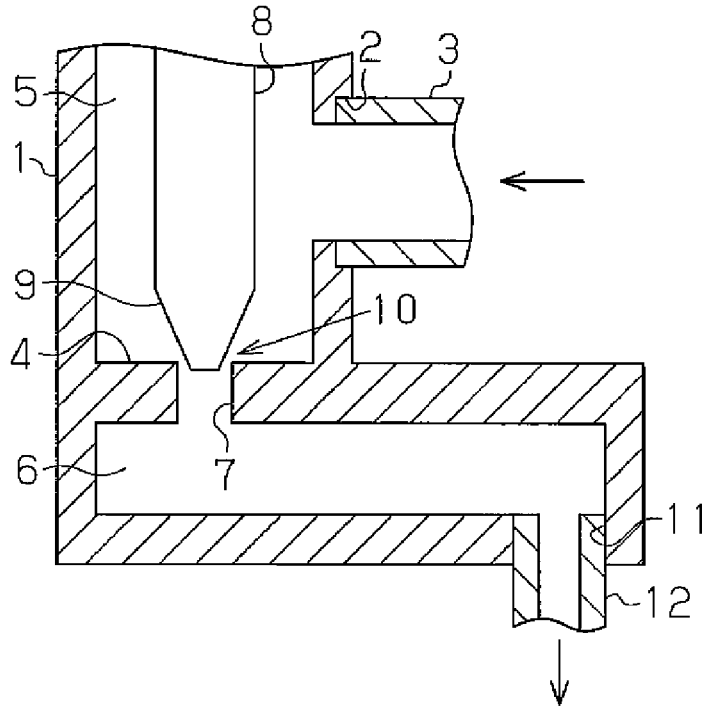
FIG. 32(*a*) is a partial longitudinal cross-sectional view illustrating an expansion valve according to a thirty-first embodiment of the present invention.
Figure 32B:
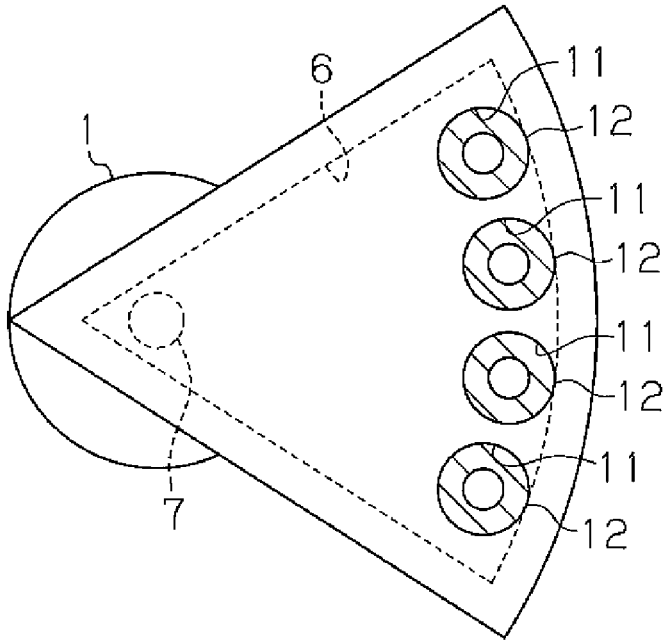

As shown in FIG. 32, the expansion valve is one in which the shape of the refrigerant flow dividing chamber 6 and attachment locations of the flow dividing tube attachment holes 11 according to the first embodiment are changed. In the present embodiment, a refrigerant flow dividing chamber 6 is formed such that, centering on the axis of a first throttle 10, the dimension in a radial direction is greater than the dimension of the axial direction of the first throttle 10. Also, the refrigerant flow dividing chamber 6 is formed in a sector form. A plurality of flow dividing tube attachment holes 11 are provided on a wall body of a valve body 1 opposite to the first throttle 10 at regular intervals along a circular arc of a sector. The refrigerant flow dividing chamber 6 is opened through flow dividing tubes 12. According to the thirty-first embodiment of the present invention, since a flow of the refrigerant ejected from the first throttle 10 hardly flows directly into the flow dividing tubes 12, a detour effect of a refrigerant flow is obtained.

Thirty-Second Embodiment

Next, an expansion valve according to a thirty-second embodiment of the present invention will be described with reference to FIG. 33.

Figure 33A:
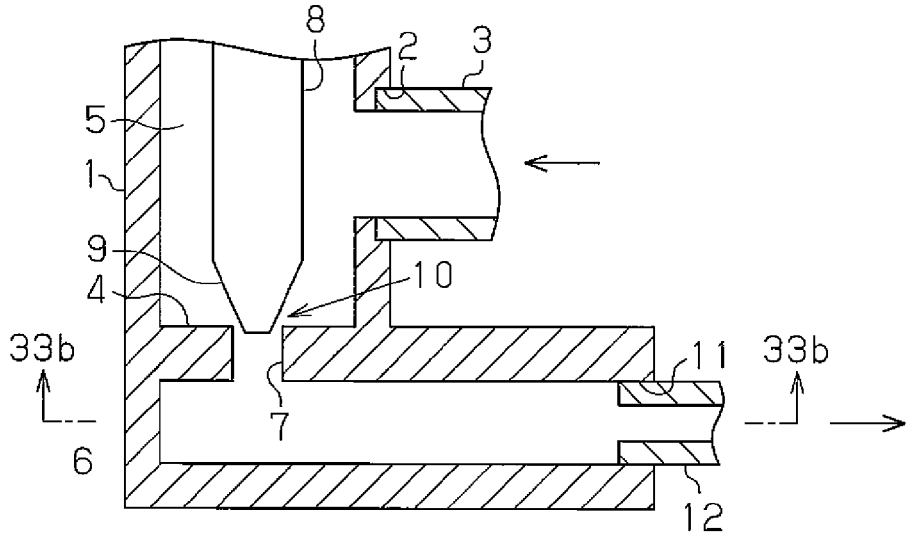
FIG. 33(*a*) is a partial longitudinal cross-sectional view illustrating an expansion valve according to a thirty-second embodiment of the present invention.
Figure 33B:
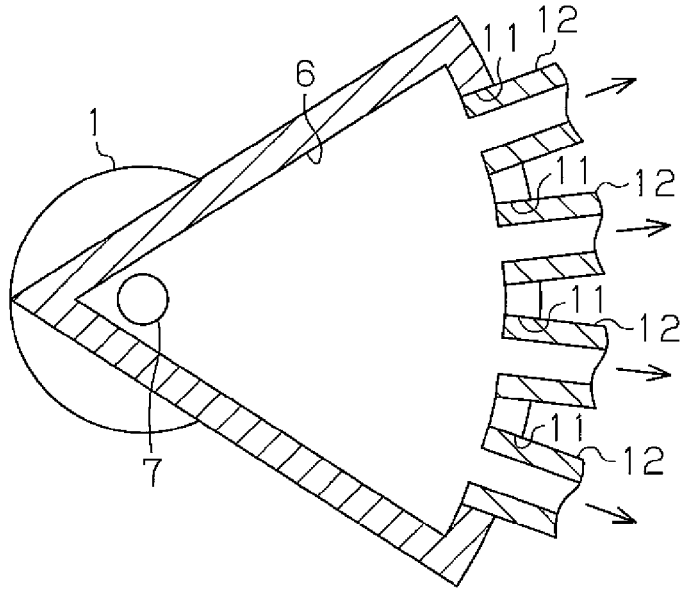

As shown in FIG. 33, the expansion valve is one in which the locations of the flow dividing tube attachment holes 11 according to the thirty-first embodiment are changed. In the present embodiment, a plurality of flow dividing tube attachment holes 11 to which flow dividing tubes 12 are attached are installed on a sidewall of a refrigerant flow dividing chamber 6. The flow dividing tubes 12 are attached in a perpendicular direction to a sidewall of the refrigerant flow dividing chamber 6. The refrigerant flow dividing chamber 6 is opened through the flow dividing tubes 12. The thirty-second embodiment of the present invention has substantially similar effects as the thirty-first embodiment of the present invention.

Thirty-Third Embodiment

Next, an expansion valve according to a thirty-third embodiment of the present invention will be described with reference to FIG. 34.

Figure 34:
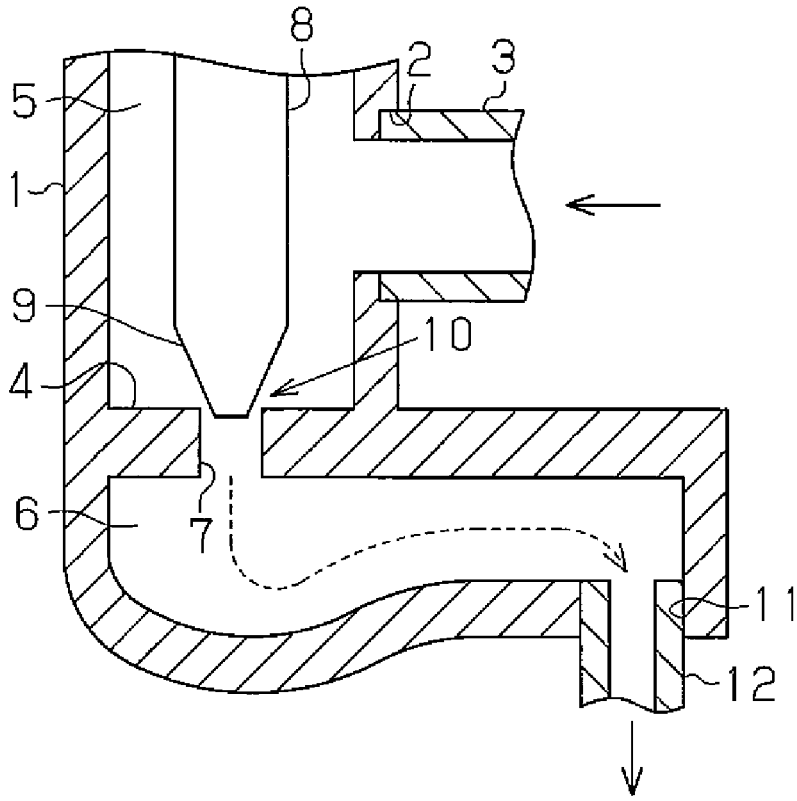
FIG. 34 is a partial longitudinal cross-sectional view illustrating an expansion valve according to a thirty-third embodiment of the present invention.

As shown in FIG. 34, the expansion valve is one in which the shape of a wall body opposite to the first throttle 10 of the refrigerant flow dividing chamber 6 according to the thirty-first embodiment of the present invention is changed. In the present embodiment, a guide portion for guiding a flow of the refrigerant ejected from a first throttle 10 toward flow dividing tube attachment holes 11 near a sidewall of a valve body 1 are formed on a wall opposite to a first throttle 10. The guide portion is formed such that the shape of a wall surface opposite to the first throttle 10 has a curved shape along a flow line of a refrigerant flow. In the thirty-third embodiment of the present invention, it is possible to prevent a turbulent flow which occurs when the direction of a flow of the refrigerant ejected from the first throttle 10 is changed. That is, when a refrigerant flow flows to the expansion valve from an inlet port 2 as a gas-liquid two-phase flow, the direction of a refrigerant flow is smoothly changed by the guide portion. Therefore, the ejection energy of a refrigerant flow is reduced, and bubbles in a refrigerant flow are subdivided, whereby a refrigerant flow noise is reduced.

Thirty-Fourth Embodiment

Next, an expansion valve according to a thirty-fourth embodiment of the present invention will be described with reference to FIG. 35.

Figure 35A:
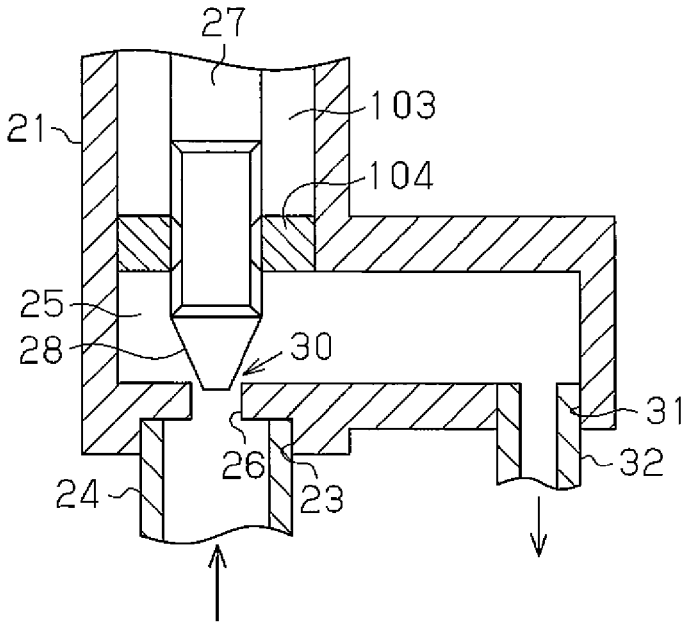
FIG. 35(*a*) is a partial longitudinal cross-sectional view illustrating an expansion valve according to a thirty-fourth embodiment of the present invention.
Figure 35B:
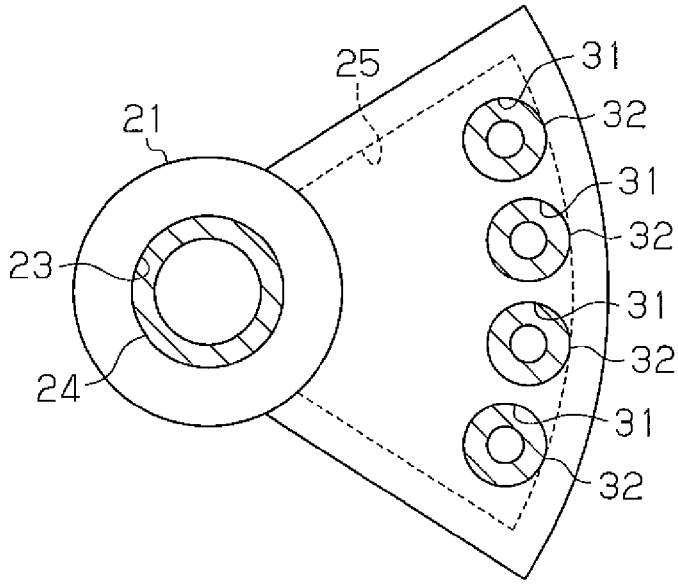

As shown in FIG. 35, the expansion valve is one in which the shape of the operation chamber 25 and attachment locations of the flow dividing tube attachment holes 11 according to the twenty-sixth embodiment are changed. In the present embodiment, an operation chamber 25 is formed such that, centering on the axis of a first throttle 30, the dimension in a radial direction is greater than the dimension of the axial direction of the first throttle 30. Also, the operation chamber 25 is formed in a sector form. A plurality of flow dividing tube attachment holes 31 are installed on a wall surface of the operation chamber 25 opposite to the first throttle 30 at regular intervals along a circular arc of a sector. The operation chamber 25 is opened through the flow dividing tubes 32 attached to the flow dividing tube attachment holes 31. According to the thirty-fourth embodiment of the present invention, since a flow of the refrigerant ejected from the first throttle 30 hardly flows directly into the flow dividing tubes 32, a detour effect of a refrigerant flow is obtained.

Thirty-Fifth Embodiment

Next, an expansion valve according to a thirty-fifth embodiment of the present invention will be described with reference to FIG. 36.

Figure 36:
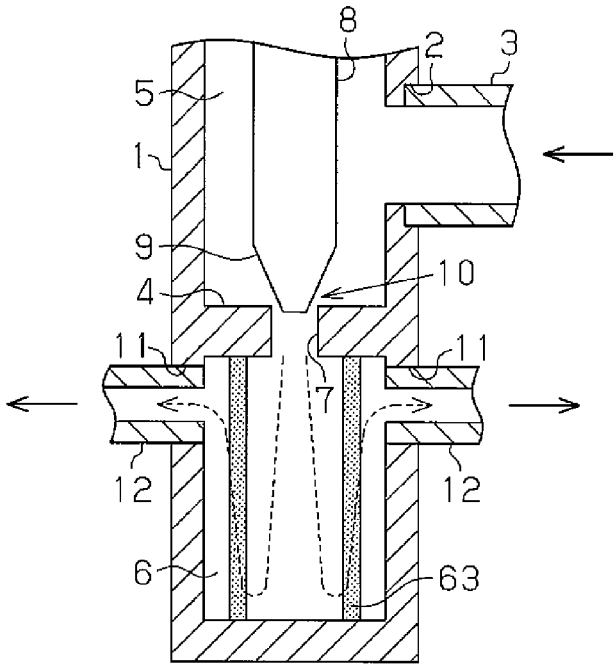
FIG. 36 is a partial longitudinal cross-sectional view illustrating an expansion valve according to a thirty-fifth embodiment of the present invention.

As shown in FIG. 36, the expansion valve is one in which the disk-shaped porous permeable layer 59 according to the eleventh embodiment is replaced with a cylindrical porous permeable layer 63. The porous permeable layer 63 is made of a material such as metal foam, ceramic, resin foam, mesh, and a porous plate. Therefore, the expansion valve according to the present embodiment has the same effects as the eleventh embodiment. That is, a discontinuous refrigerant flow noise is reduced, whereby the flow dividing characteristic of the refrigerant of a refrigerant flow dividing chamber 6 is improved. Also, due to the porous permeable layer 63, it is possible to prevent clogging of a first throttle 10 which may occur due to foreign substances when refrigerant flows in a reverse direction.

Thirty-Sixth Embodiment

Next, an expansion valve according to a thirty-sixth embodiment of the present invention will be described with reference to FIG. 37.

Figure 37:
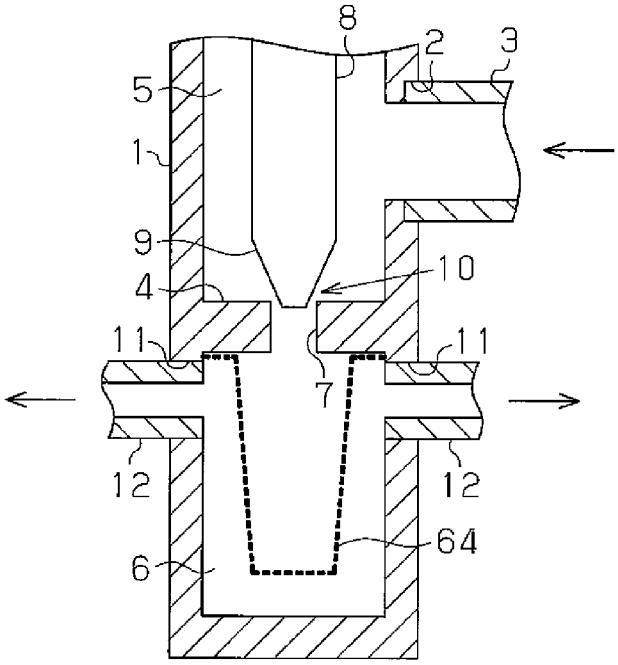
FIG. 37 is a partial longitudinal cross-sectional view illustrating an expansion valve according to a thirty-sixth embodiment of the present invention.

As shown in FIG. 37, the expansion valve is one in which the disk-shaped porous permeable layer 63 according to the thirty-fifth embodiment is replaced with a permeable layer 64 made of mesh. The permeable layer 64 is formed in a cup form. According to the present embodiment, the same effects as the eleventh and thirty-fifth embodiments are obtained. That is, a discontinuous refrigerant flow noise is reduced, whereby the flow dividing characteristic of the refrigerant of a refrigerant flow dividing chamber 6 is improved. Also, since the permeable layer 64 is made of mesh, it is possible to prevent clogging of a first throttle 10 which may occur due to foreign substances when refrigerant flows in a reverse direction.

Thirty-Seventh Embodiment

Next, an expansion valve according to a thirty-seventh embodiment of the present invention will be described with reference to FIG. 38.

Figure 38:
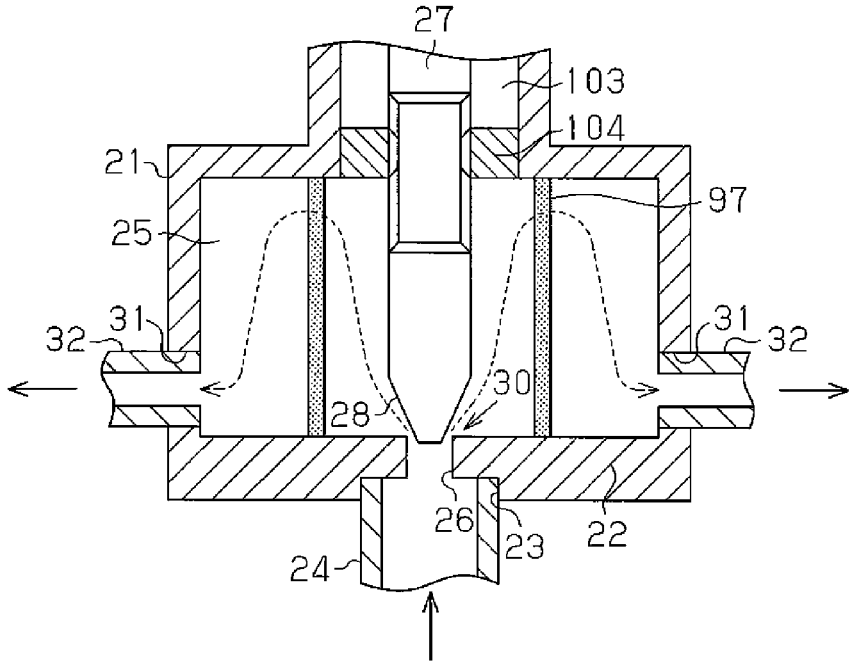
FIG. 38 is a partial longitudinal cross-sectional view illustrating an expansion valve according to a thirty-seventh embodiment of the present invention.

As shown in FIG. 38, the expansion valve is one in which a porous permeable layer 97 is disposed inside the operation chamber 25, i.e., on the downstream side of the first throttle 30 according to the twenty-sixth embodiment. The cylindrical porous permeable layer 97 is disposed inside an operation chamber 25 coaxially with a valve rod 27. The porous permeable layer 97 is made of a material such as metal foam, ceramic, resin foam, mesh, and a porous plate.

According to the expansion valve of the present embodiment, a flow of the refrigerant ejected from a first throttle 30 collides with a wall surface opposite to the first throttle 30, reverses, and then passes through the porous permeable layer 97 to be directed toward flow dividing tubes 32. At this time, when the refrigerant flow passes through the porous permeable layer 97, the ejection energy of the refrigerant flow is consumed, and bubbles in the refrigerant are subdivided, so that the liquid refrigerant is mixed with bubbles. As a result, the velocity fluctuation and the pressure fluctuation of a refrigerant flow are mitigated, and so a discontinuous refrigerant flow noise is reduced. Also, the flow state of a refrigerant flow directed toward each flow dividing tube 32 becomes uniform, so that the flow dividing characteristic of the refrigerant of the operation chamber 25 is improved. Also, due to the porous permeable layer 97, it is possible to prevent clogging of the first throttle 30 which may occur due to foreign substances when refrigerant flows in a reverse direction.

Thirty-Eighth Embodiment

Next, an expansion valve according to a thirty-eighth embodiment of the present invention will be described with reference to FIG. 39.

Figure 39:
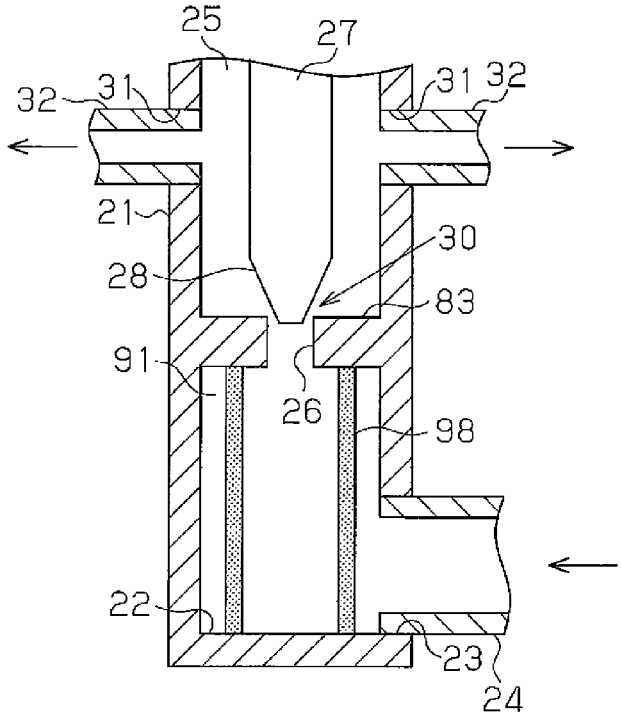
FIG. 39 is a partial longitudinal cross-sectional view illustrating an expansion valve according to a thirty-eighth embodiment of the present invention.

As shown in FIG. 39, in the expansion valve, as with the eighteenth embodiment, the inside of a valve body 21 is partitioned into an upper chamber and a lower chamber by a first partition wall 83. The upper chamber (a downstream side of a first throttle) is formed as an operation chamber 25, and the lower chamber (an upstream side of the first throttle) is formed as a space portion 91. In the space portion 91 of the valve body 21, a cylindrical porous permeable layer 98 is installed on the upstream side of the first throttle as bubble subdividing means. The porous permeable layer 98 is made of a material such as metal foam, ceramic, resin foam, mesh, and a porous plate.

In the expansion valve according to the present embodiment of the present invention, when a refrigerant flow flows to the expansion valve from an inlet port 23 with a slug flow or a plug flow, a refrigerant flow passes through the porous permeable layer 98, and so bubbles in a refrigerant flow are subdivided, whereby a discontinuous refrigerant flow noise is reduced. Also, since foreign substances in a refrigerant are removed by the porous permeable layer 98, it can also serve as a filter.

Thirty-Ninth Embodiment

Next, an expansion valve according to a thirty-ninth embodiment of the present invention will be described with reference to FIG. 40.

Figure 40A:
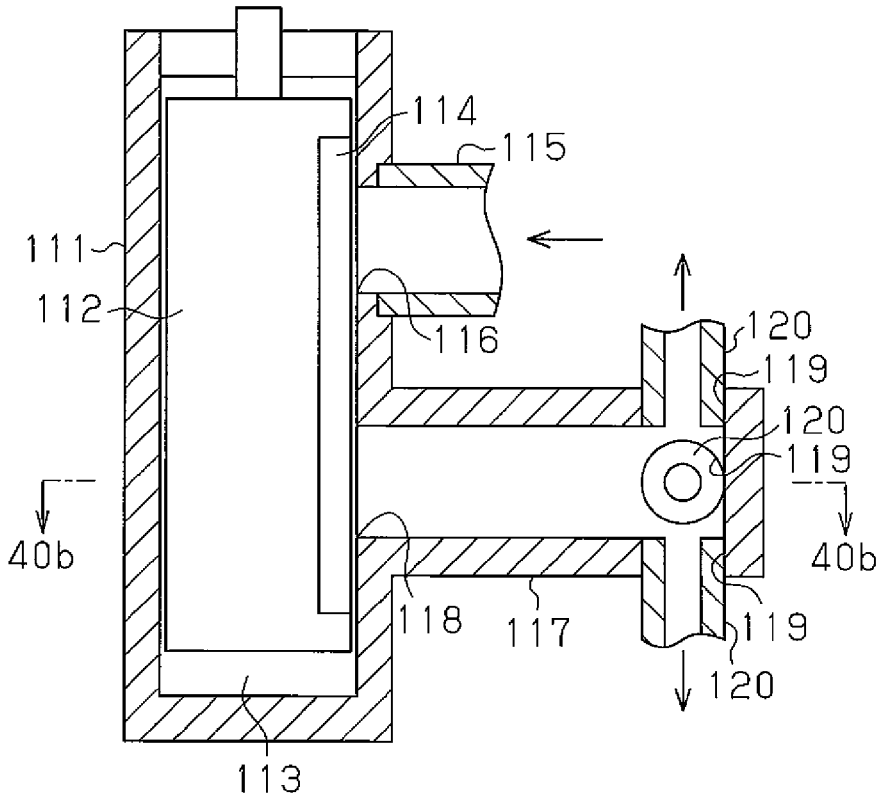
FIG. 40(*a*) is a partial longitudinal cross-sectional view illustrating an expansion valve according to a thirty-ninth embodiment of the present invention.
Figure 40B:
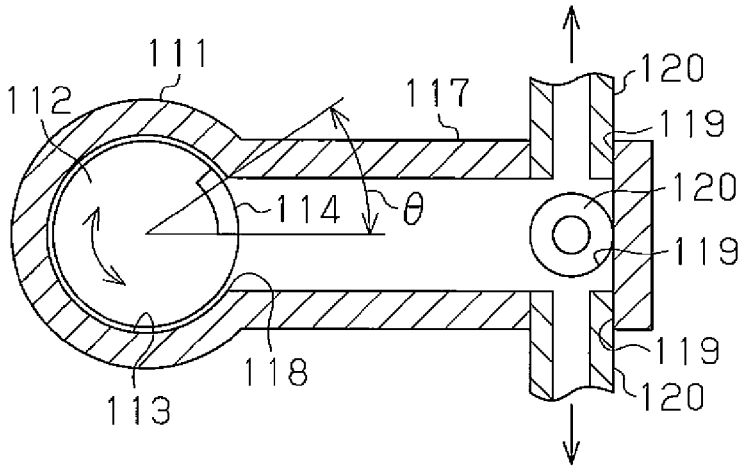

As shown in FIG. 40, the expansion valve according to the present embodiment is a rotary-type expansion valve. The expansion valve includes a cylindrical casing 111, and a valve chamber 113 which accommodates a rotary-type valve body 112 is formed in the casing 111. The valve body 112 is disposed coaxially with the casing 111. The valve body 112 can be slid and rotated with respect to an inner circumferential surface of the casing 111 by a driving unit (not shown) disposed in the upper portion the casing 111. Circular arc-shaped arrows shown in FIG. 40(*b*) denote a rotation direction of the valve body 112. A valve passage 114 which includes a longitudinal groove is formed on a surface portion of the valve body 112 corresponding to a predetermined rotation angle. In the casing 111, a communication hole 116 connected to a liquid tube 115 and a communication hole 118 connected to a tubular refrigerant flow dividing chamber 117 are formed at a location of the same angle centering on the axis of the casing 111. Both communication holes 116 and 118 correspond to the valve holes in each of the embodiments described above. A throttling degree is adjusted depending on an overlapping angle θ of both communication holes 116 and 118 and the valve passage 114. Therefore, in the thirty-ninth embodiment of the present invention, first and second throttles are formed from both communication holes 116 and 118 and the groove-shaped valve passage 114.

The refrigerant flow dividing chamber 117 is installed in a horizontal direction in a lower portion of the casing 111 or installed inside a tubular body which extends in a perpendicular direction to the axis of the casing 111. On a distal end of the tubular body, four flow dividing tube attachment holes 119 are installed at regular intervals along an outer circumferential surface of the tubular body. Each of flow dividing tubes 120 is attached to each of the flow dividing tube attachment holes 119.

In the expansion valve according to the present embodiment, a decompression level of liquid refrigerant flowing in from the liquid tube 115 is adjusted depending on an overlapping angle θ of the valve passage 114 and both communication holes 116 and 118. Refrigerant decompressed by both throttles is converted into a low-pressure gas-liquid two-phase flow to be sprayed into the refrigerant flow dividing chamber 117 from the communication hole 118. Also, since the flow dividing tube attachment hole 119 is disposed apart from the communication hole 118, a flow of the refrigerant ejected from the communication hole 118 does not flow directly to an inlet of the flow dividing tube 120. As a result, a refrigerant flow is uniformly divided in the refrigerant flow dividing chamber 117 with respect to each of the flow dividing tubes 120 without being influenced by gravity or direct spraying.

Also, when liquid refrigerant flows to the expansion valve from the liquid tube 115 with a slug flow or a plug flow, since liquid refrigerant and gaseous liquid (bubbles) alternately flow through the throttle, the velocity fluctuation and the pressure fluctuation easily occur in a refrigerant flow, so that a discontinuous refrigerant flow noise is easily generated. According to the present embodiment, since the refrigerant flow dividing chamber 117 which expands a refrigerant passage is formed on the downstream side of the throttle which includes both communication holes 116 and 11S and the valve passage 114, the ejection energy of a refrigerant flow which has passed through the throttle is dispersed in the refrigerant flow dividing chamber 117. As a result, the velocity fluctuation and the pressure fluctuation of a refrigerant flow are mitigated, whereby a discontinuous refrigerant flow noise is prevented.

Fortieth Embodiment

Next, an expansion valve according to a fortieth embodiment of the present invention will be described with reference to FIG. 41.

Figure 41:
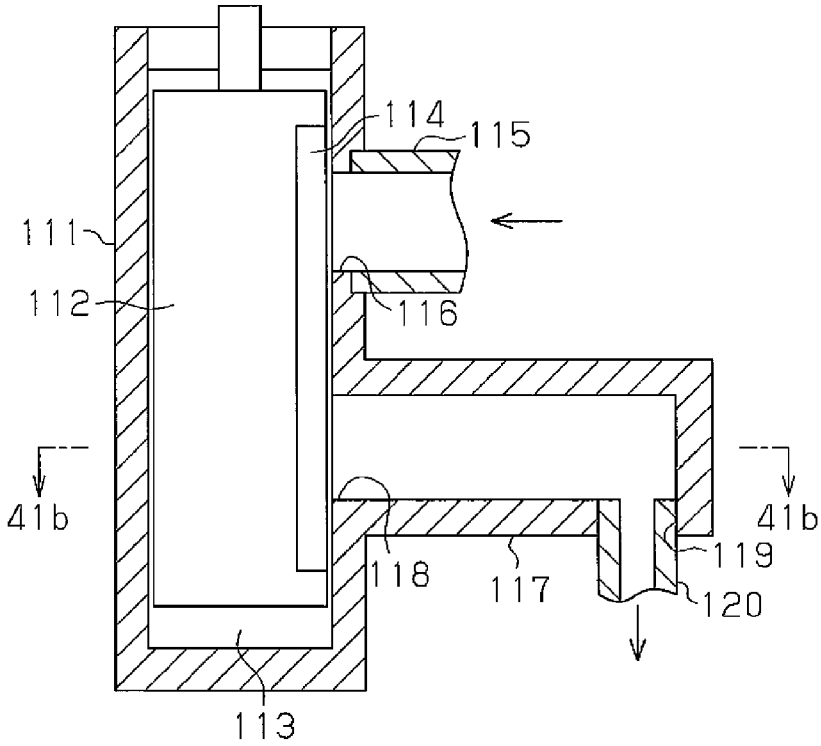
FIG. 41(*a*) is a partial longitudinal cross-sectional view illustrating an expansion valve according to a fortieth embodiment of the present invention.
Figure 41:
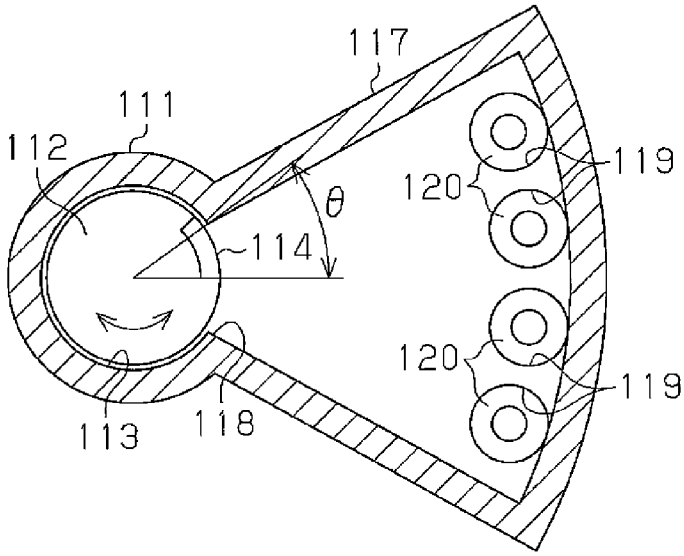

As shown in FIG. 41, the expansion valve is one in which the shape of the refrigerant flow dividing chamber 117 and an attachment location of the flow dividing tube attachment hole 119 according to the thirty-ninth embodiment are changed. In the present embodiment, a refrigerant flow dividing chamber 117 is formed in a sector form which is widened in a radial direction centering on a communication hole 118. A plurality of flow dividing tube attachment holes 119 are installed on a wall body which constitutes the refrigerant flow dividing chamber 117 at regular intervals along a circular arc of a sector. A flow dividing tube 120 is inserted into, passes through, and is fixed to each of the flow dividing tube attachment holes 119. The refrigerant flow dividing chamber 117 is opened through the flow dividing tubes 120. According to the present embodiment of the present invention, the same effects as the thirty-ninth embodiment are obtained. Also, unlike the thirty-ninth embodiment, a plurality of flow dividing tubes 120 can be connected to the refrigerant flow dividing chamber 117 toward the same direction (vertical direction).

Forty-First Embodiment

Next, an expansion valve according to a forty-first embodiment of the present invention will be described with reference to FIG. 42. The expansion valve according to the present embodiment is one in which refrigerant flow dividing chamber according to the first embodiment is basically enlarged, and another valve chamber is disposed in the refrigerant flow dividing chamber.

Figure 42:
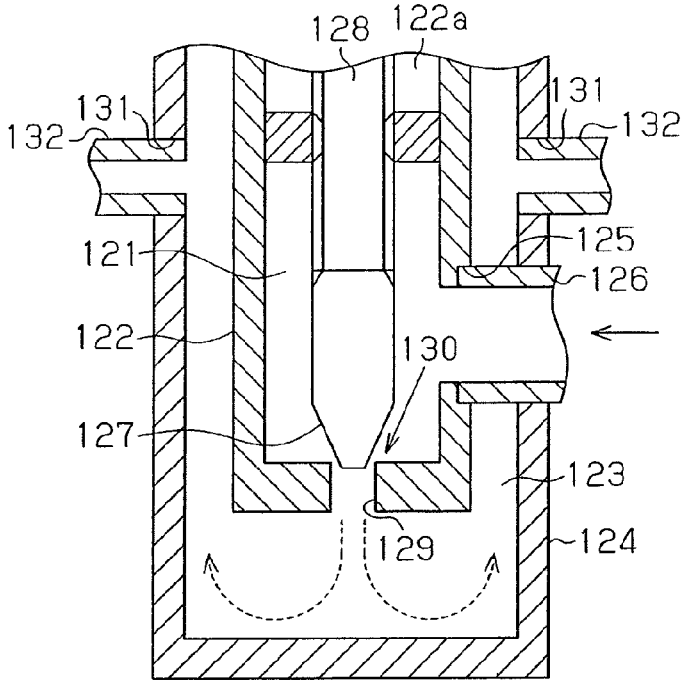
FIG. 42 is a partial longitudinal cross-sectional view illustrating an expansion valve according to a fortieth first embodiment of the present invention.
Figure 43:
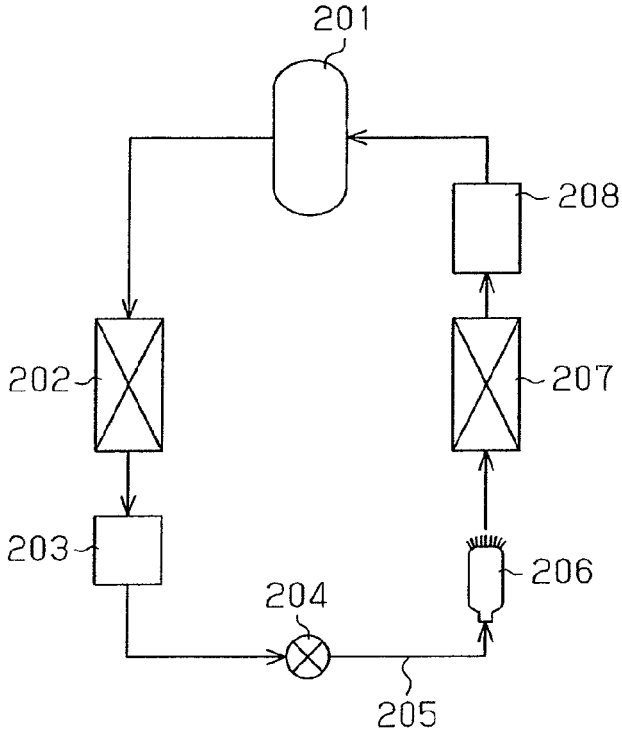
Fig.43 PRIOR ART
FIG. 43 is a general circuit diagram illustrating a refrigerant circuit in a conventional refrigeration unit.

As shown in FIG. 42, the expansion valve has a double casing structure which includes a cylindrical first vessel 122 which forms a valve chamber 121 and a cylindrical second vessel 124 which forms a refrigerant flow dividing chamber 123. The first vessel 122 has a similar configuration to the valve chamber of the first embodiment. An inlet port 125 is formed on a side surface of the first vessel 122, and a liquid tube 126 is connected to the inlet port 125. The liquid tube 126 penetrates an outer circumferential wall of the second vessel 124. A valve rod 128 which has a first valve body (needle valve) 127 at its distal end is accommodated in the valve chamber 121. A first valve hole 129 is formed in the bottom wall of the first vessel 122. The valve rod 128 can be moved forward or backward with respect to the first valve hole 129 in a driving unit (not shown) in a driving portion 122*a*. In the present embodiment, a first throttle 130 is configured from the first valve body 127 of the valve rod 128 and the first valve hole 129.

The whole first vessel 122 is accommodated in the refrigerant flow dividing chamber 123. The refrigerant flow dividing chamber 123 communicates with the valve chamber 121 through the first valve hole 129. Flow dividing tube attachment holes 131 are provided in an upper portion of the refrigerant flow dividing chamber 123, and flow dividing tubes 132 are attached to the flow dividing tube attachment holes 131. In this expansion valve, a flow of the refrigerant ejected from the first throttle 130 is sprayed to the bottom wall of the refrigerant flow dividing chamber 123. After the direction of a refrigerant flow is changed from a downward direction to an upward direction, it passes through between the first vessel 122 and the second vessel 124 to be flown into the flow dividing tube 132.

In the expansion valve according to the present embodiment, a liquid refrigerant flow flowing in from the liquid tube 126 is first decompressed by the first throttle 130. A refrigerant decompressed in the first throttle 130 is converted into a low-pressure gas-liquid two-phase flow to be sprayed into the refrigerant flow dividing chamber 123 from the first throttle 130. The flow dividing tube attachment hole 131 is located in an upper portion of the refrigerant flow dividing chamber 123 so that a flow of the refrigerant ejected from the first throttle 130 does not flow directly to an inlet of the flow dividing tube 132. Accordingly, a refrigerant flow is uniformly divided in the refrigerant flow dividing chamber 123 with respect to each flow dividing tube 132 without being influenced by gravity or direct spraying.

Also, when liquid refrigerant flows to the expansion valve from the liquid tube 126 with a slug flow or a plug flow, since liquid refrigerant and a gas refrigerant (bubbles) alternately flow, the velocity fluctuation and the pressure fluctuation easily occur in a refrigerant flow, whereby a discontinuous refrigerant flow noise is easily generated. According to the present embodiment, since the refrigerant flow dividing chamber 123 which expands a refrigerant passage is formed on the downstream side of the first throttle 130, the ejection energy of a refrigerant flow is dispersed in the refrigerant flow dividing chamber 123, and so the velocity fluctuation and the pressure fluctuation of a refrigerant flow are mitigated, thereby preventing a discontinuous refrigerant flow noise.

Each of the above embodiments of the present invention described above may be modified as follows.

In the third embodiment, the second valve body 39 and the second valve hole 38 which have a tapered surface may be replaced with a valve body which has an outer circumferential surface parallel to the axis of the valve rod 8 and a valve hole which has an inner circumferential surface parallel to the axis of the valve rod 8, respectively. A plurality of throttling passages may be installed by forming a plurality of helical grooves on the second valve body 39. Also, a straight groove shown in the sixteenth embodiment of the present invention may be employed instead of a helical groove. This groove may be formed on an inner circumferential surface of the second valve hole 38 other than an outer circumferential surface of the second valve body 39. Also, the second valve body 39 or the second valve hole 38 which does not have the groove may be employed. A cross-sectional shape of the groove may be changed to various shapes such as a semi-circular shape, a triangular shape, and a rectangular shape. The modified embodiments may be employed in the third throttle 45 of the seventh embodiment. The modified embodiments may be employed in the second and third throttles 35 and 45 of the twelfth embodiment, in the second throttle 35 of the thirteenth embodiment, in the third throttle 65 of the fourteenth embodiment, in the third throttle 75 of the sixteenth embodiment, and in the second throttle 82 of the seventeenth embodiment.

In the fourth embodiment, the enlarged diameter portion 42 may be formed in a tapered form, and a cross-sectional shape of the helical groove 42*a* may be changed to various shapes such as a semi-circular shape, a triangular shape and a rectangular shape. The modified embodiment may be employed in the turbulent flow generating member 51 of the eighth embodiment of the present invention. Similarly, the modified embodiment may be employed in the cylindrical portion 55 of the ninth embodiment, in the cylindrical portion 61 of the tenth embodiment, in the turbulent flow generating member 51 of the thirteenth embodiment, in the turbulent flow generating member 72 having the helical groove 72*a* of the fifteenth embodiment, and in the turbulent flow generating member 92 of the eighteenth embodiment.

In the third embodiment, the two-step throttle configured by the first and second throttles 10 and 35 is included, but a refrigerant flow resistance ratio between the respective throttles is not limited. This is equally applied to the multi-step throttle of the seventh embodiment, the twelfth embodiment, the thirteenth embodiment, the fourteenth embodiment, the sixteenth embodiment, and the seventeenth embodiment.

In the third embodiment, the seventh embodiment, the twelfth embodiment, the thirteenth embodiment, the fourteenth embodiment, and the seventeenth embodiment, the enlarged space portions 36, 46, 66, and 81 installed at an upstream side or a downstream side of the first throttle 10 may be omitted.

In the ninth embodiment, the guide portion 62 of the tenth embodiment may be installed on a wall surface opposite to the first throttle 10 in the refrigerant flow dividing chamber 6. Also in this case, since the direction of a refrigerant flow is smoothly changed, a discontinuous refrigerant flow noise is reduced, so that the flow dividing characteristic of the refrigerant of the refrigerant flow dividing chamber 6 is improved.

In the nineteenth to twenty-fourth, thirty-fifth, and thirty-sixth embodiments, as with the third embodiment, the second throttle 35 and the enlarged space portion 36 may be installed as bubble subdividing means. Therefore, the bubble subdividing effect is improved, and a refrigerant flow flowing in from the first throttle 10 becomes continuous, whereby a discontinuous refrigerant flow noise is reduced. Also, in this case, the second valve body 39 and the second valve hole 38 which have a tapered surface may be replaced with a valve body and a valve hole which have a surface and an inner circumferential surface parallel to the axis of the second valve body and valve hole 39 and 38, respectively. A plurality of helical grooves may be installed on the second valve body 39. Also, a straight groove of the thirteenth embodiment of the present invention may be installed instead of the helical groove.

In the nineteenth to twenty-fourth, thirty-fifth, and thirty-sixth embodiments, as with the fourth embodiment, a turbulence generating portion may be installed as bubble subdividing means. In detail, the enlarged diameter portion 42 may be formed at an intermediate location of the valve rod 8, and the helical groove 42*a* may be formed on the enlarged diameter portion 42. As a result, bubbles in a refrigerant are subdivided, whereby a discontinuous refrigerant flow noise is reduced.

In the nineteenth to twenty-fourth, thirty-fifth, and thirty-sixth embodiments, as with the fifth and sixth embodiment, the cylindrical porous permeable layer 43 or the torus shaped porous permeable layer 44 may be installed inside the valve chamber 5. In this case, bubbles in a refrigerant are removed, and dust is removed.

The invention claimed is:

1. An expansion valve with a refrigerant flow dividing structure, comprising:

a first throttle formed by a first valve body and a first valve hole, wherein the opening degree of the first valve hole is adjusted by the first valve body;

a refrigerant flow dividing chamber for dividing refrigerant which has passed through the first throttle into a plurality of flow dividing tubes, the refrigerant flow dividing chamber being formed on a downstream side of the first throttle;

flow dividing tube attachment holes which are installed in the refrigerant flow dividing chamber and to which each of the flow dividing tubes is attached;

a valve chamber which accommodates the first valve body, the valve chamber being formed on an upstream side of the first throttle; and a cylindrical portion for guiding a refrigerant ejected from the first throttle toward a wall surface opposite to the first throttle, the cylindrical portion being arranged in the refrigerant flow dividing chamber, wherein the flow dividing tube attachment holes are formed in a portion of a sidewall of the refrigerant flow dividing chamber near the first throttle, a flow of the refrigerant ejected from the first throttle collides with a wall body opposite to the first throttle, reverses, and then flows into the flow dividing tubes, and wherein the first throttle is formed integrally with the refrigerant flow dividing chamber.

2. The expansion valve with a refrigerant flow dividing chamber structure according to claim 1, wherein a helical groove is formed on an outer circumferential surface of the cylindrical portion.

3. The expansion valve with a refrigerant flow dividing chamber structure according to claim 2, wherein in the refrigerant flow dividing chamber, a guide portion for changing the direction of a flow of the refrigerant ejected from the cylindrical portion is formed on a wall surface opposite to the first throttle.

4. The expansion valve with a refrigerant flow dividing chamber structure according to claim 1, wherein a helical groove is formed on an inner circumferential surface of the cylindrical portion.

* * * * *